US010443793B2

(12) United States Patent
Fretz et al.

(10) Patent No.: US 10,443,793 B2
(45) Date of Patent: Oct. 15, 2019

(54) FAIRLEAD WITH A LIGHTING SYSTEM

(71) Applicant: Warn Industries, Inc., Clackamas, OR (US)

(72) Inventors: Darren G. Fretz, Oregon City, OR (US); Craig A. Clark, Estacada, OR (US); Bryan Averill, Portland, OR (US)

(73) Assignee: WARN INDUSTRIES, INC., Clackamas, OR (US)

( * ) Notice: Subject to any disclaimer, the term of this patent is extended or adjusted under 35 U.S.C. 154(b) by 204 days.

(21) Appl. No.: 15/587,299

(22) Filed: May 4, 2017

(65) Prior Publication Data

US 2017/0321851 A1 Nov. 9, 2017

Related U.S. Application Data

(60) Provisional application No. 62/331,558, filed on May 4, 2016.

(51) Int. Cl.

| | |
|---|---|
| ***F21S 2/00*** | (2016.01) |
| ***B63B 21/10*** | (2006.01) |
| ***B66D 1/36*** | (2006.01) |
| ***F21V 7/04*** | (2006.01) |
| ***F21V 31/00*** | (2006.01) |
| ***B63B 21/14*** | (2006.01) |
| *F21Y 115/10* | (2016.01) |
| *F21V 3/00* | (2015.01) |

(52) U.S. Cl.

CPC ..... *F21S 2/005* (2013.01); *B63B 21/10* (2013.01); *B63B 21/14* (2013.01); *B66D 1/36* (2013.01); *F21V 7/04* (2013.01); *F21V 31/005* (2013.01); *F21V 3/00* (2013.01); *F21Y 2115/10* (2016.08)

(58) Field of Classification Search

CPC ..... F21S 2/005; B63B 21/10; B63B 21/14; B66D 1/36; F21V 7/04; F21V 31/005; F21V 3/00; F21Y 2115/10

USPC ..... 362/234

See application file for complete search history.

(56) References Cited

U.S. PATENT DOCUMENTS

2016/0131322 A1* 5/2016 Chen ..... B60Q 1/0041 362/511

* cited by examiner

*Primary Examiner* — Bao Q Truong
*Assistant Examiner* — Jessica M Apenteng
(74) *Attorney, Agent, or Firm* — K&L Gates LLP

(57) ABSTRACT

Systems are provided for a fairlead, and in particular to fairlead including an integrated lighting system. In one example, a fairlead may comprise a frame, the frame including a central, first opening and a second opening disposed above the first opening. The second opening may house an integrated lighting system, the integrated lighting system including a plurality of lights.

19 Claims, 17 Drawing Sheets

FAIRLEAD WITH A LIGHTING SYSTEM

CROSS REFERENCE TO RELATED APPLICATIONS

The present application claims priority to U.S. Provisional Patent Application No. 62/331,558, entitled "A Fairlead with a Lighting System," filed on May 4, 2016, the entire contents of which are hereby incorporated by reference for all purposes.

FIELD

The present application relates generally to lighting systems for a fairlead.

SUMMARY/BACKGROUND

A fairlead, such as a hawse fairlead, may be used to guide and restrict lateral movement of a rope and/or cable, as the rope and/or cable is pulled through the fairlead. Fairleads may be used in winches, hoists, boats, and other applications where a rope and/or cable is subjected to bi-directional motion. In some applications, such as in winching operations, it may be desirable to attach lights to the fairlead to increase visibility. The lights may be attached to a frame of the fairlead, and may provide increased illumination in front of the fairlead.

However, the inventors herein have recognized several problems with such fairleads. As one example, aftermarket lights that are attached to the fairlead may require increased electrical wiring, leading to added expense. Further, such attachable fairlead lights may be exposed to environmental elements, such as rain, snow, dirt, mud, etc., which may degrade the lights. Additionally, multiple lights must be added to the fairlead to provide both front and rear lighting of the fairlead. Thus in one example, the above issues may be at least partially addressed by a fairlead, comprising: a frame including a central, first opening and a second opening spaced away from the first opening; and a lighting system included within the frame, the lighting system comprising a plurality of lights disposed within and extending along the second opening. In some examples, the integrated lighting system may include LED lights. The LED lights may comprise a circuit board including a semiconductor light source that generates visible light in response to a supplied electric current. The circuit board may be in face-sharing contact with inner walls of the frame within the second opening.

In this way, the structural integrity and longevity of fairlead lights may be increased by integrating the lighting system within the frame of the fairlead and thus reducing exposure to environmental elements. Further, heat dissipation from the circuit board of the LED lights may be increased by positioning the circuit board in physical contact with the frame of the fairlead. As such, performance and operational periods of the lights may be increased.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

The figures are drawn to scale, although other relative dimensions may be used, if desired.

DETAILED DESCRIPTION

Figure 6:
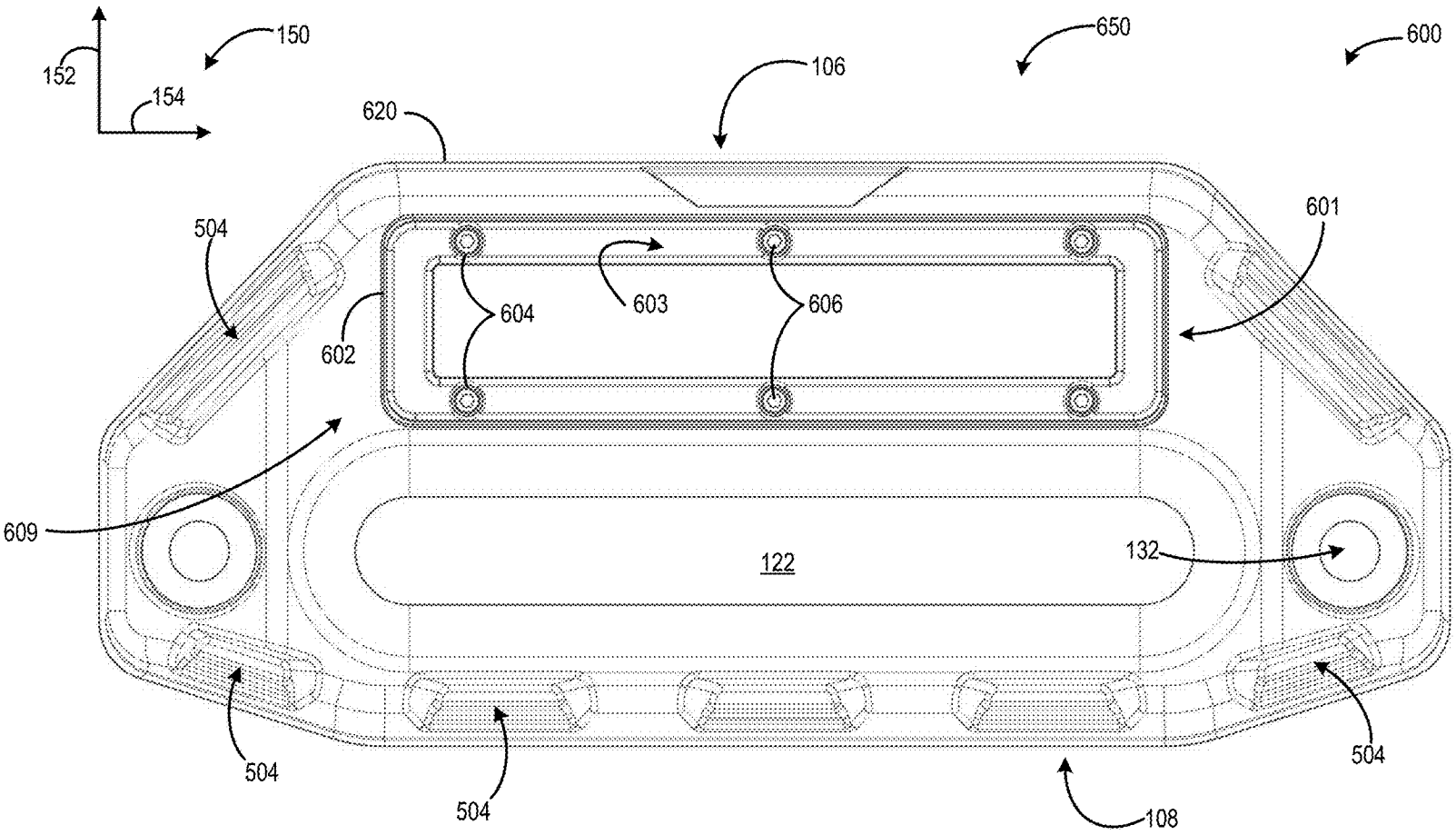
FIG. 6 shows a front view of a fairlead including a second example integrated lighting system, in accordance with one or more embodiments of the present disclosure.
Figure 7:
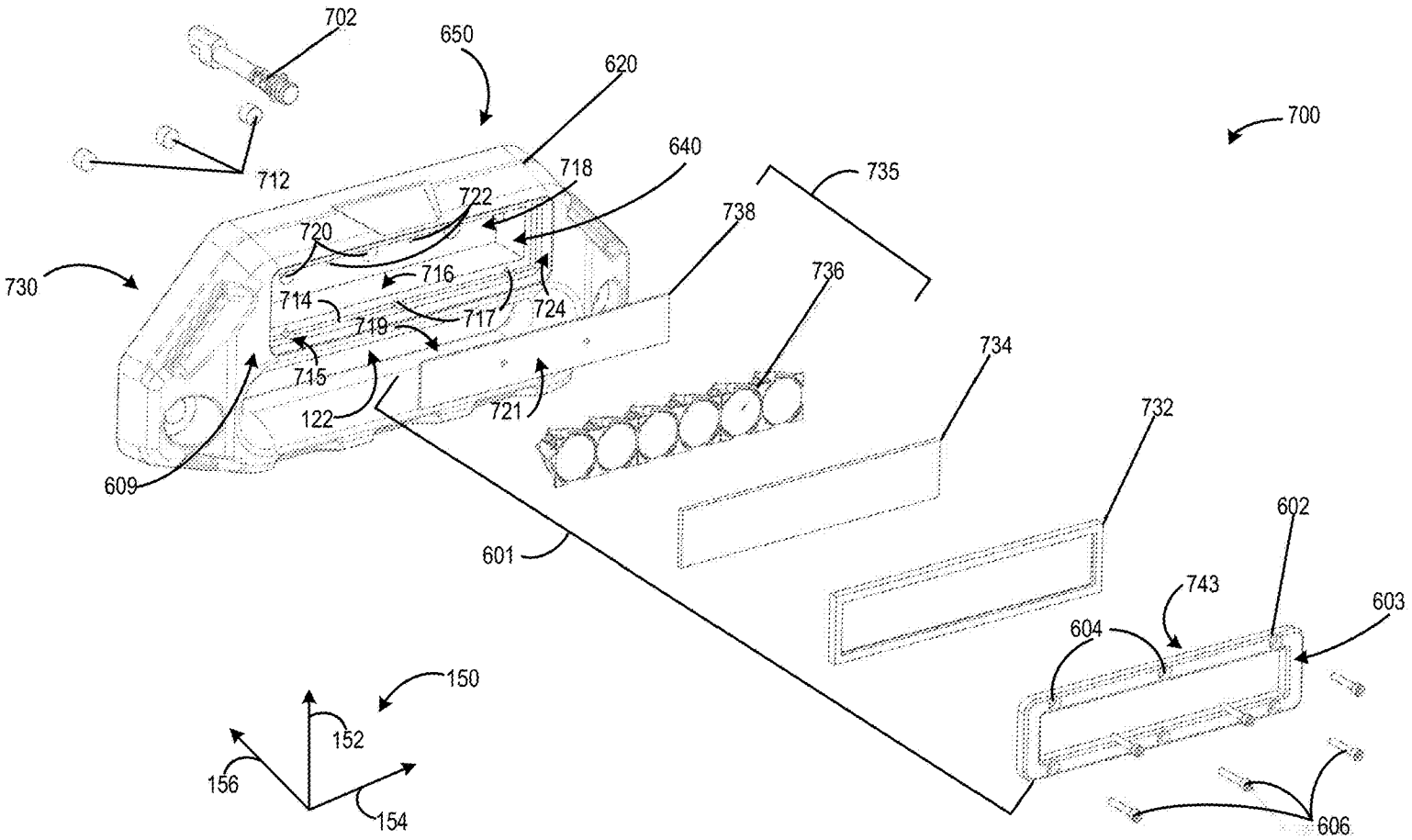
FIG. 7 shows an exploded view of the fairlead of FIG. 6, in accordance with one or more embodiments of the present disclosure.
Figure 8:
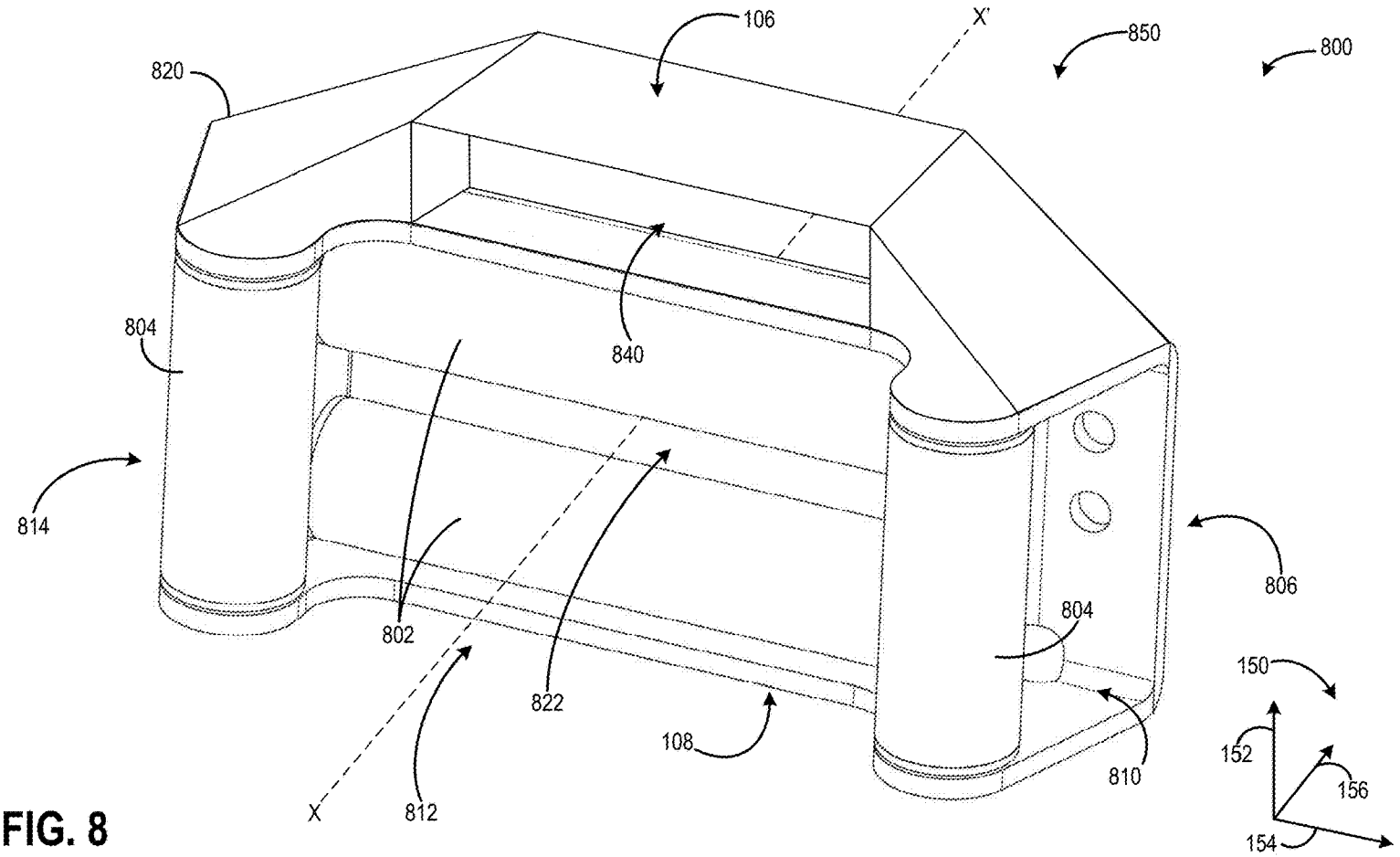
FIG. 8 shows a front perspective view of a roller fairlead that includes a third example of an integrated lighting system, in accordance with one or more embodiments of the present disclosure.
Figure 9:
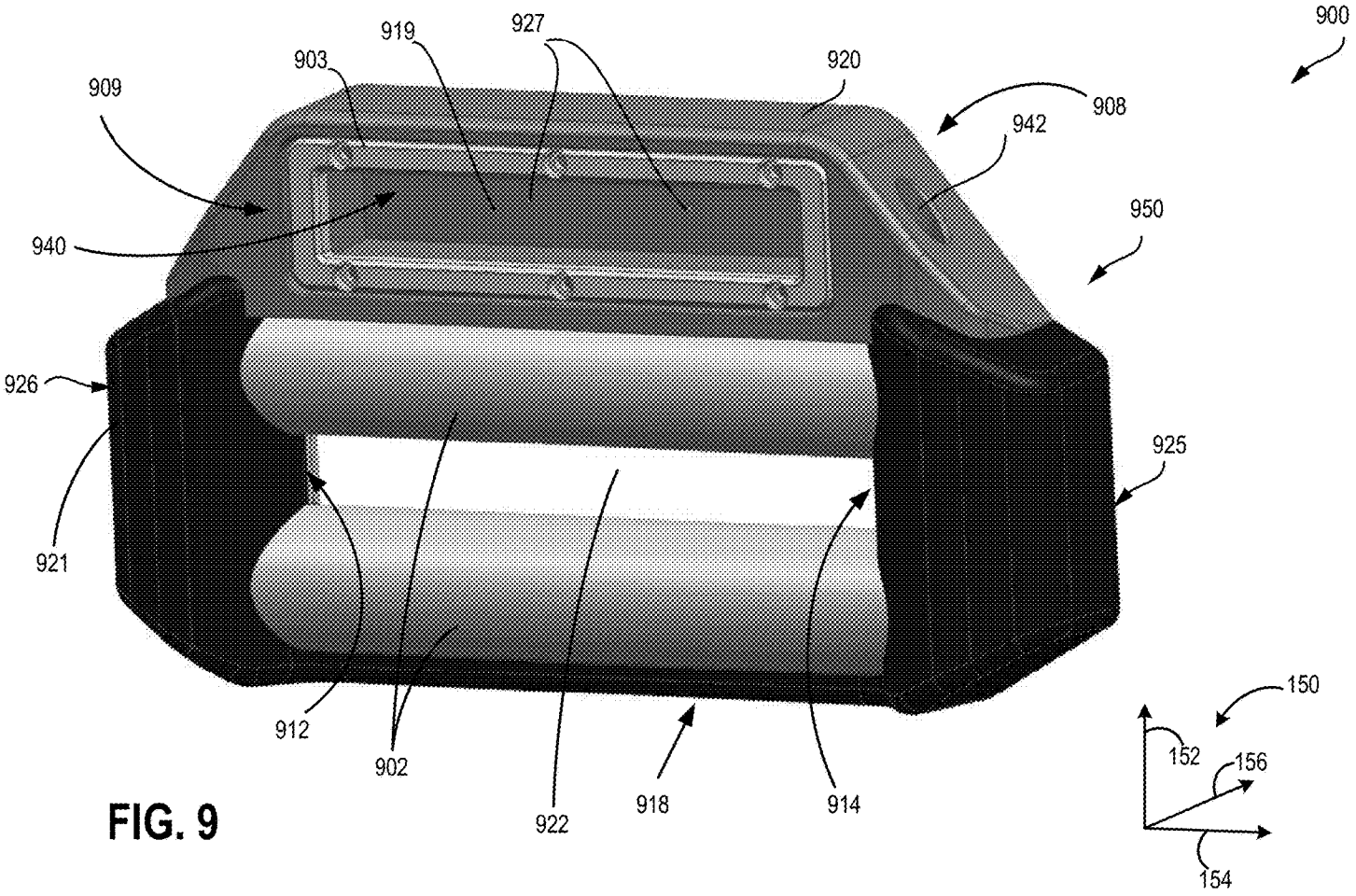
FIG. 9 shows a front perspective view of a roller fairlead that includes a fourth example of an integrated lighting system, in accordance with one or more embodiments of the present disclosure.
Figure 10:
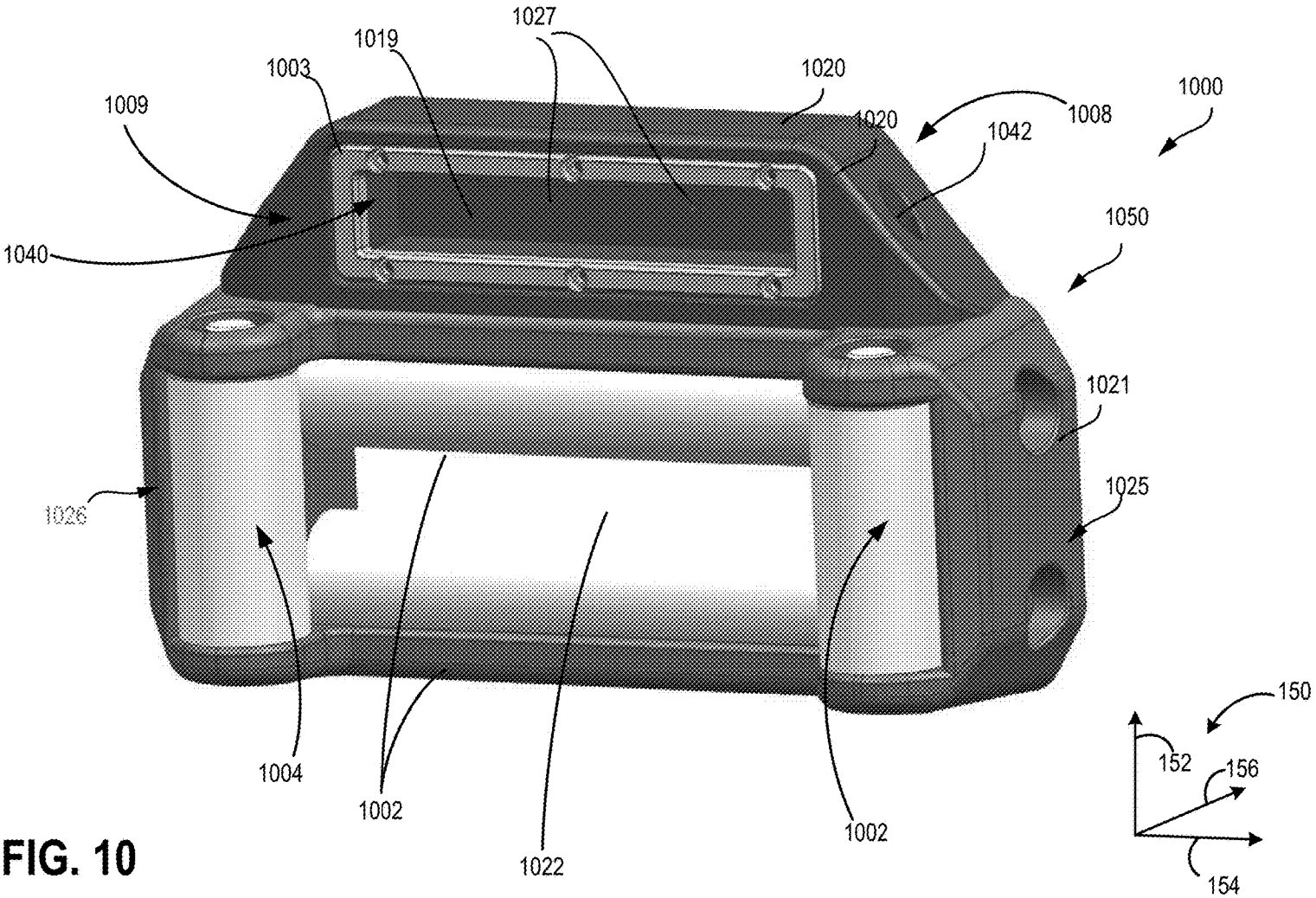
FIG. 10 shows a front perspective view of a roller fairlead that includes a fifth example of an integrated lighting system, in accordance with one or more embodiments of the present disclosure.
Figure 11:
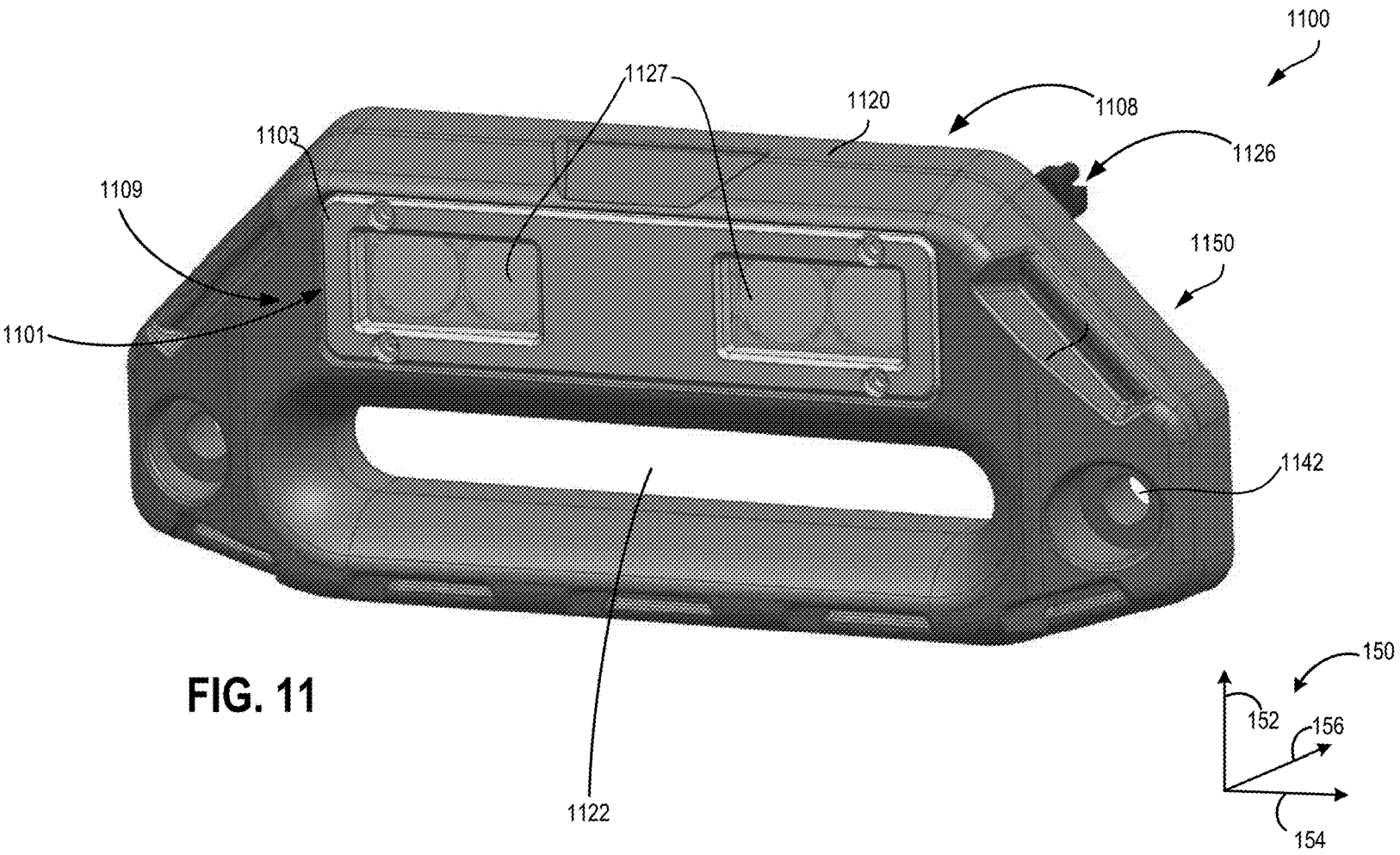
FIG. 11 shows a front perspective view of the fairlead of FIG. 1, including a sixth example of an integrated lighting system, in accordance with one or more embodiments of the present disclosure.
Figure 12:
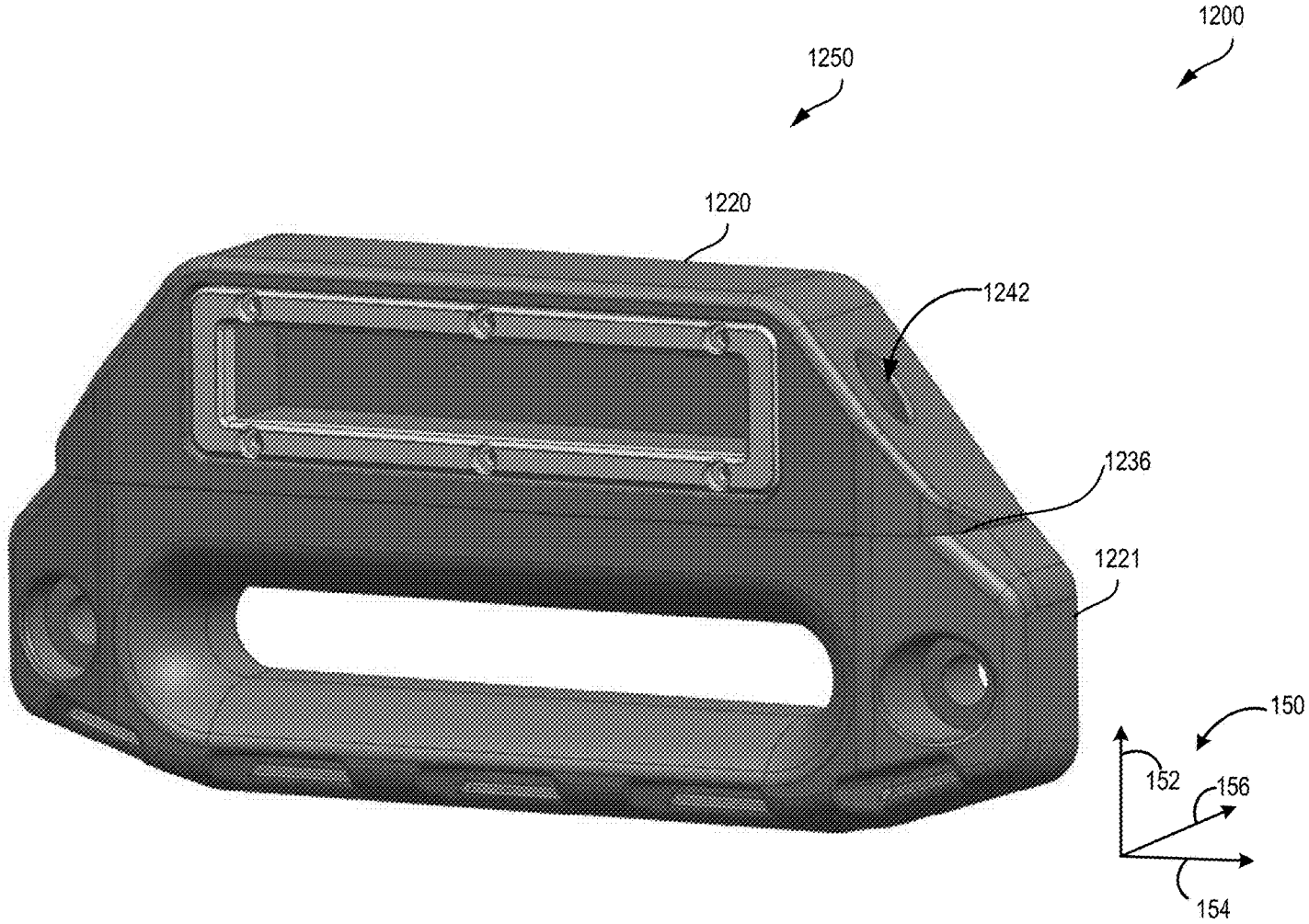
FIG. 12 shows a front perspective view of a fairlead including a seventh example of an integrated lighting system, in accordance with one or more embodiments of the present disclosure.
Figure 13:
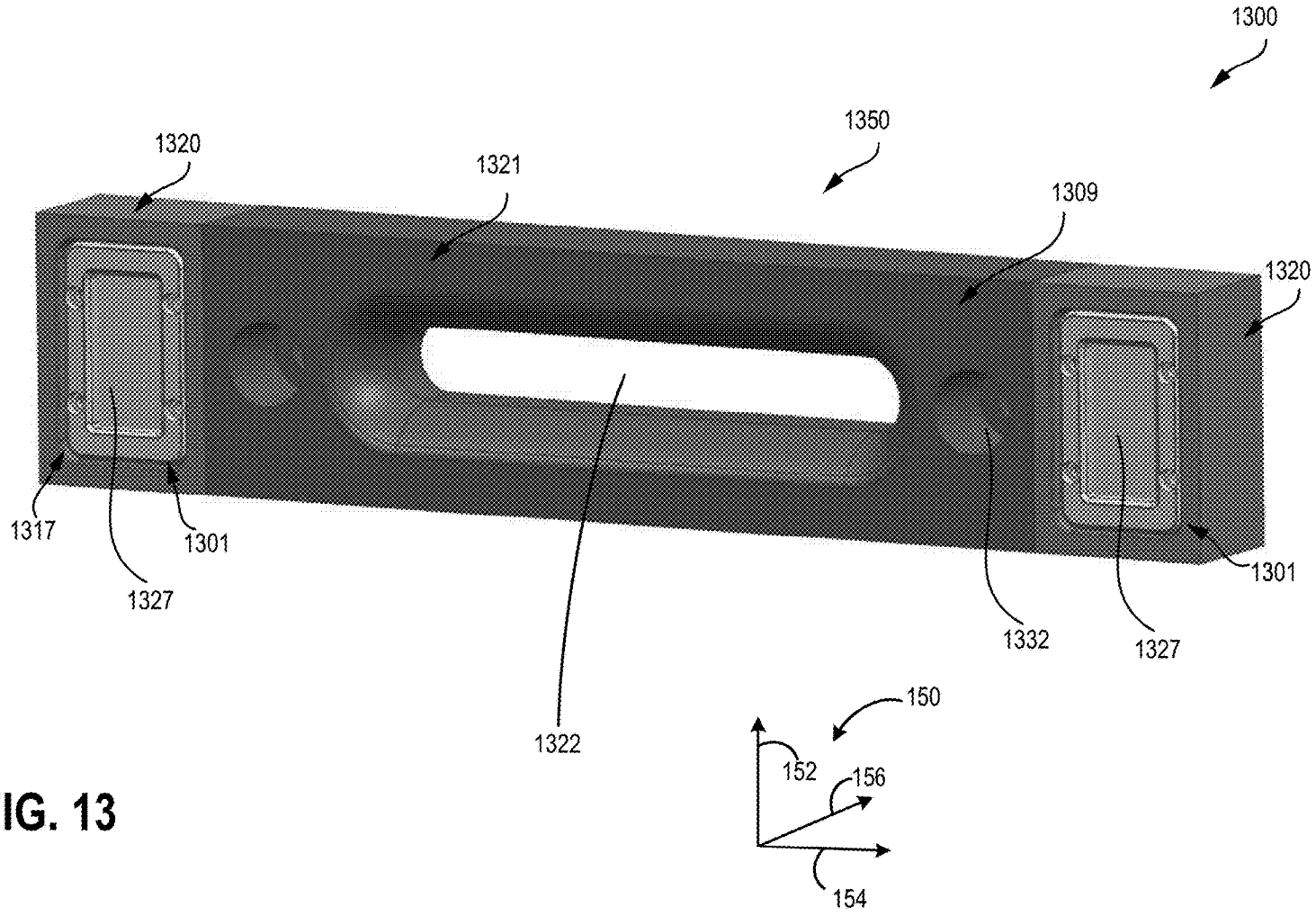
FIG. 13 shows a front perspective view of a fairlead including an eighth example of an integrated lighting system, in accordance with one or more embodiments of the present disclosure.
Figure 14:
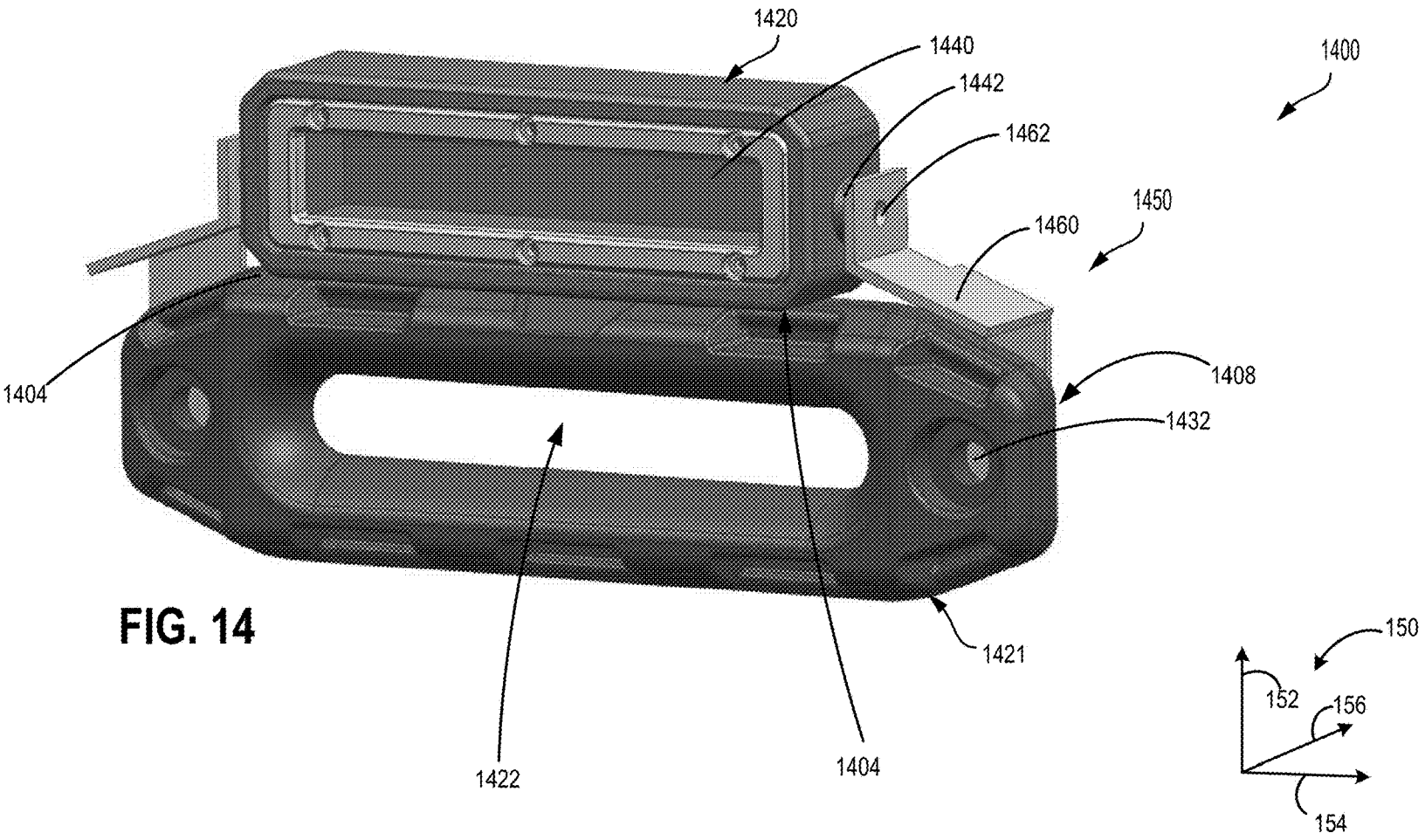
FIG. 14 shows a front perspective view of a fairlead including a ninth example of an integrated lighting system, in accordance with one or more embodiments of the present disclosure.
Figure 15:
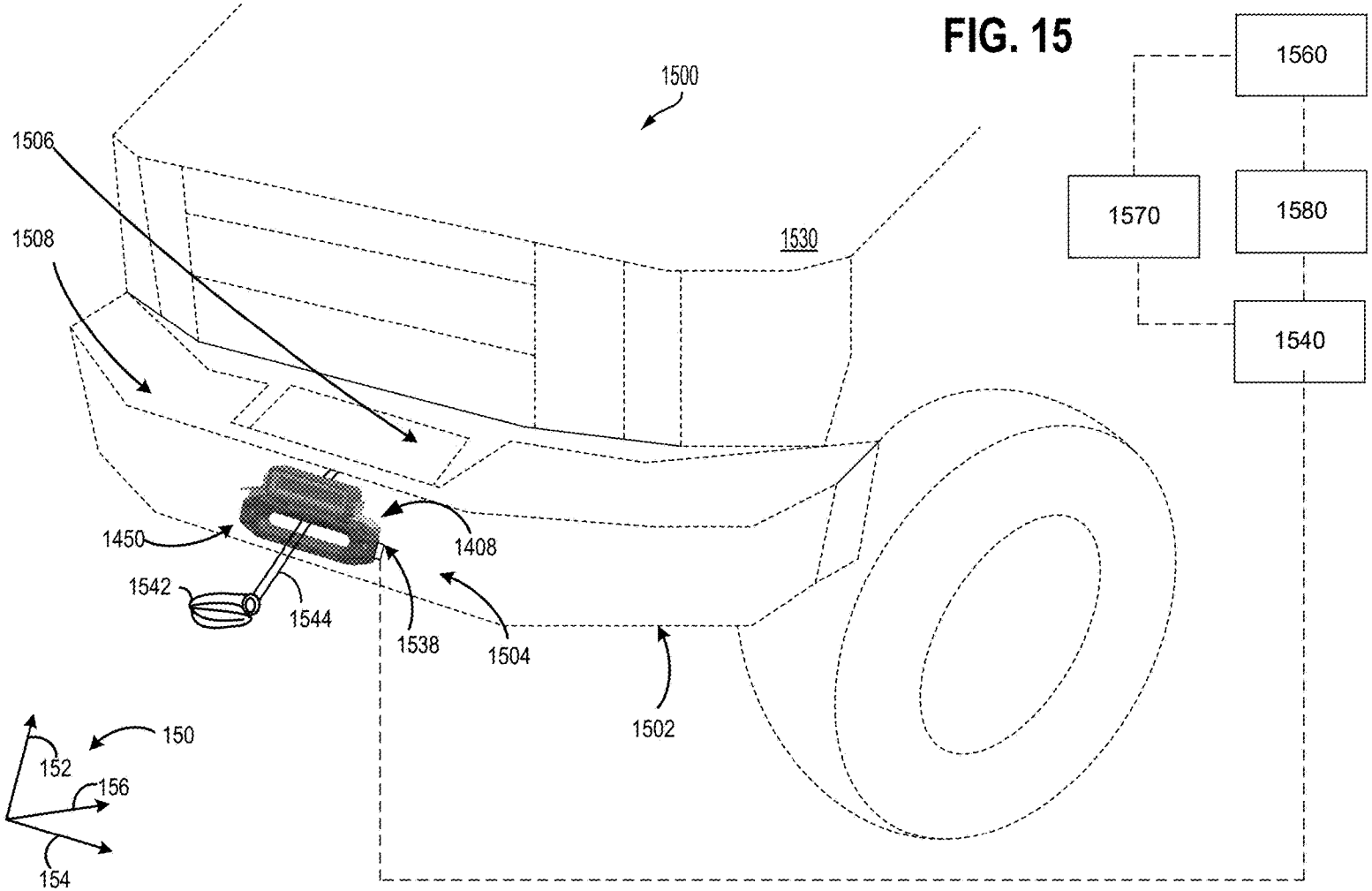
FIG. 15 shows a front perspective view of a fairlead, including the sixth example of an integrated lighting system, as it may couple to a vehicle bumper, in accordance with one or more embodiments of the present disclosure.
Figure 16:
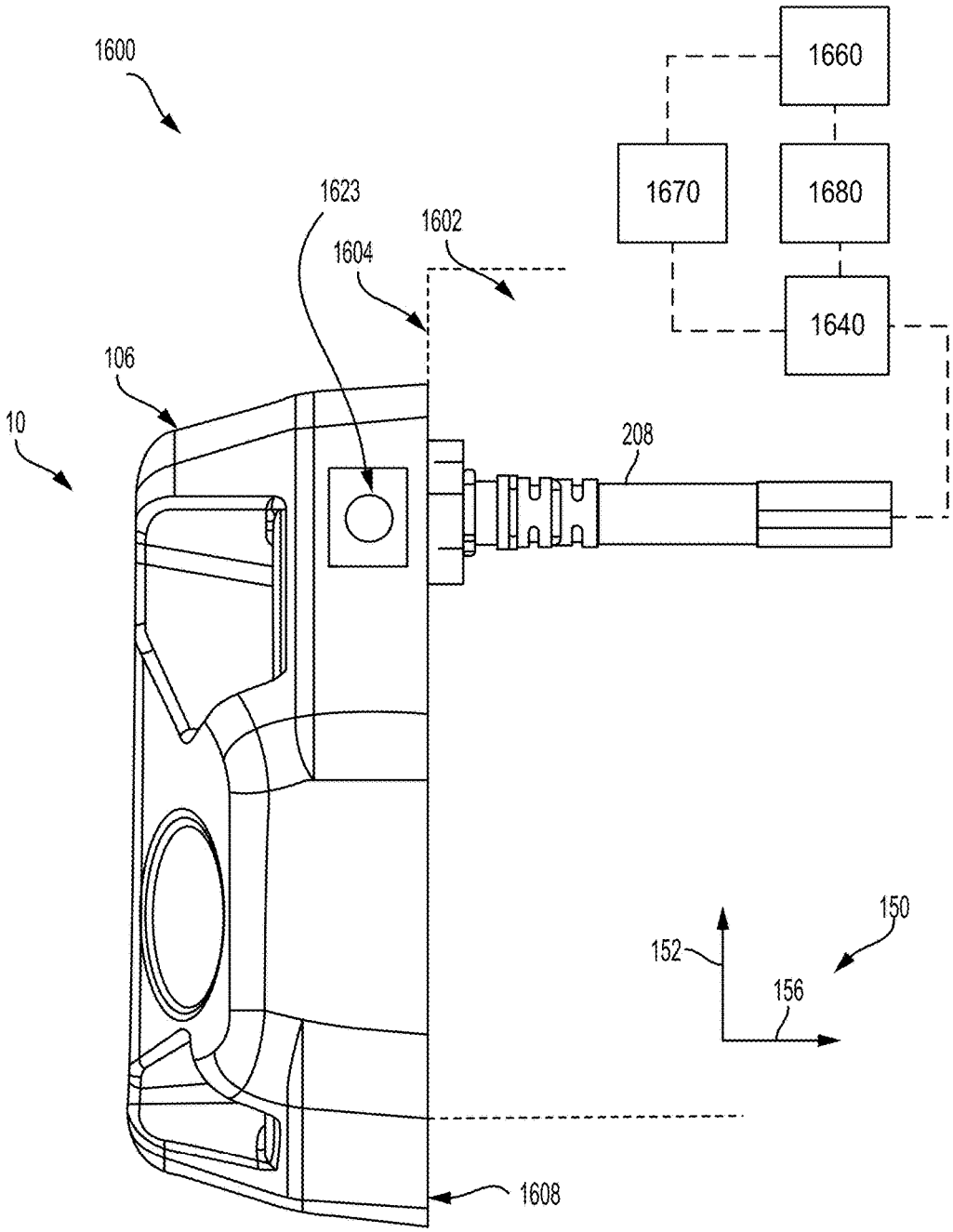
FIG. 16 shows a side view of the fairlead of FIG. 16, as it may couple to a vehicle bumper and an example embodiment of a control system, in accordance with one or more embodiments of the present disclosure.
Figure 17:
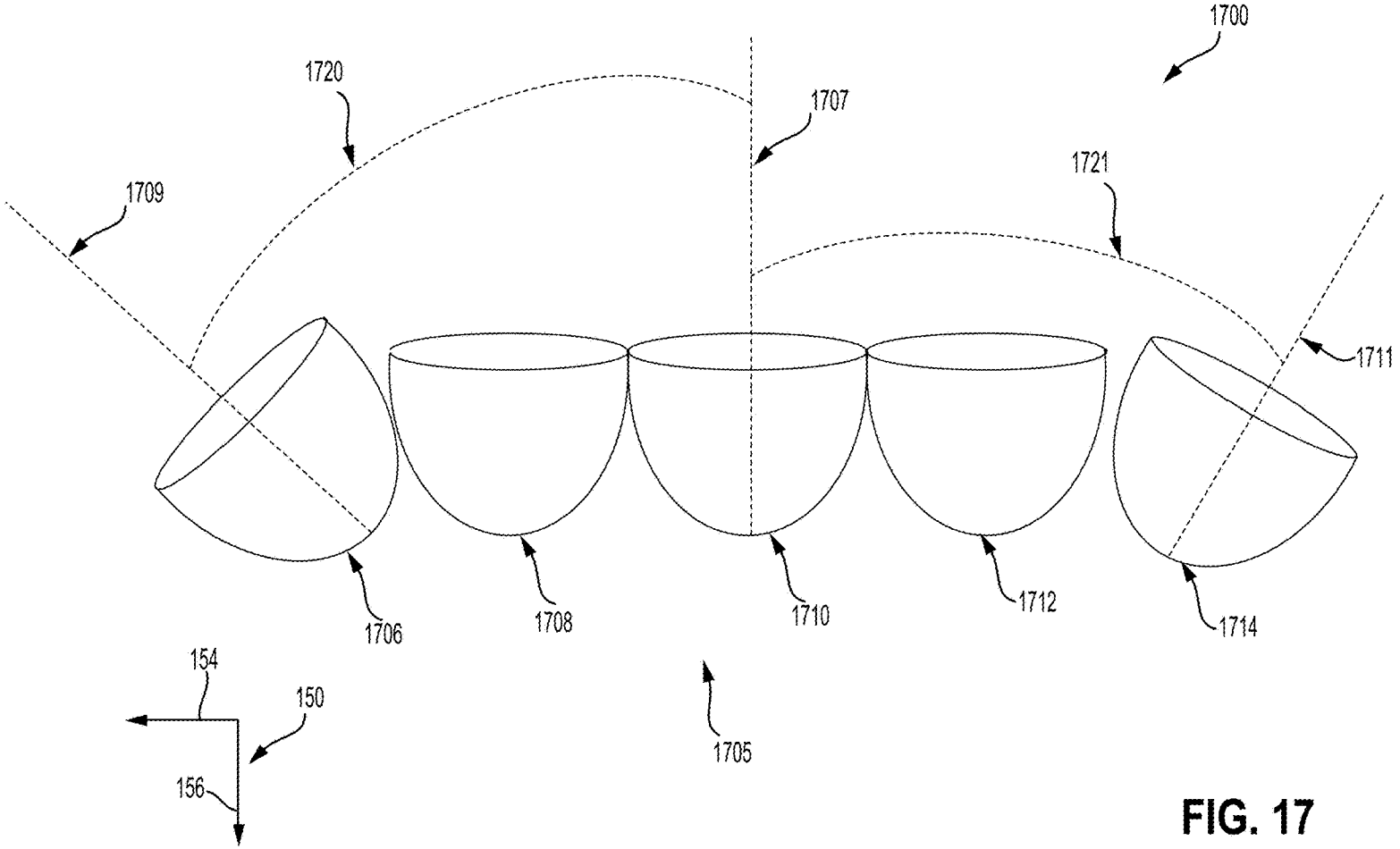
FIG. 17 shows a top view of the lights of an integrated lighting system in one example aiming configuration.

The following detailed description relates to fairleads, and in particular to lighting systems for fairleads. A fairlead, such as any of the example hawse fairleads shown in FIGS. 1-7 and 11-16 and/or example roller fairleads shown in FIG. 8, may guide and restrict lateral movement of a rope and/or cable, as the rope and/or cable is pulled through the fairlead. Specifically, the rope and/or cable may extend through a first opening in the fairlead and lateral movement of the rope and/or cable may be constrained to within the first opening. The fairlead may additionally include one or more additional openings that house an integrated lighting system. In some examples, the integrated lighting system may be inserted into a second opening of the fairlead frame from a back of a frame of the fairlead, as shown in FIGS. 1-5. In the description herein, such examples where the lighting system is loaded into the frame from a back of the frame may be referred to as "back-loaded." FIGS. 6-7 show examples embodiments where the lighting system may be loaded into the frame from a front of the frame. In the description herein, such examples where the lighting system is loaded into the frame from the front of the frame may be referred to as "front-loaded." FIG. 8 shows an example of a roller fairlead that may include an integrated lighting system (e.g., in either the back-loaded or front-loaded configuration). FIGS. 9 and 10 show examples of roller fairleads that may include a front-loaded integrated lighting system. By integrating the lights within the frame of the fairlead, heat dissipation from the lighting system may be increased, and the complexity of the system may be reduced. FIG. 11 shows an example fairlead that includes an integrated lighting system that may include more than one separate lighting element, and the frame of the fairlead may be a single piece (e.g., forged). FIG. 12 shows an example of a fairlead that includes an integrated lighting system that may be coupled to a two-piece fairlead frame using a suitable attachment method. FIG. 13 shows an example of a fairlead that includes integrated lighting system light components on a first and a second side of the fairlead opening, the first and second sides being opposite one another about an axis through the center of the fairlead opening. FIG. 14 shows an example of a fairlead that includes an integrated light assembly that may be mounted between a bumper and a fairlead. It will be appreciated that any and all of the fairlead embodiments included in this disclosure may be mounted to the surface of a vehicle bumper and may include a control system, as shown in FIG. 15. Additionally, some integrated light systems may be configured with a coupling mechanism between a front surface of the bumper and the fairlead, as shown in FIG. 16. In some examples, an integrated lighting system may be configured to adjust the angle of one or more light subassemblies in order to illuminate a desired area or object, as shown in FIG. 17.

FIGS. 1-17 show the relative positioning of various components of a fairlead. If shown directly contacting each other, or directly coupled, then such components may be referred to as directly contacting or directly coupled, respectively, at least in one example. Similarly, components shown contiguous or adjacent to one another may be contiguous or adjacent to each other, respectively, at least in one example. As an example, components lying in face-sharing contact with each other may be referred to as in face-sharing contact or physically contacting one another. As another example, elements positioned apart from each other with only a space there-between and no other components may be referred to as such, in at least one example.

Further, FIGS. 1-17 include an axis system 150, which may be used to describe the relative positioning of components of the fairlead. The axis system 150 may include a vertical axis 152, a lateral axis 154, and a longitudinal axis 156. The axes 152, 154, and 156 may be orthogonal to one another, thereby defining a three-dimensional axis system. As used herein, "top/bottom", "upper/lower", and "above/below", may be relative to the vertical axis 152 and may be used to describe the positioning of elements of the figures relative to one another along the vertical axis 152. Thus, a first component described as "vertically above" a second component may be positioned vertically above the second component relative to the vertical axis 152 (e.g., in a positive direction along axis 152 relative to the second component). Similarly, "to the left/right of," and "to the side of" may be used to describe the positioning of elements of the figures relative to one another along the lateral axis 154 and may be used to describe the positioning of elements of the figures relative to one another along the lateral axis 154. Further, "in front of," and "behind" may be relative to the longitudinal axis 156 and may be used to describe the positioning of element of the figures relative to one another along the longitudinal axis 156.

As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Figure 3:
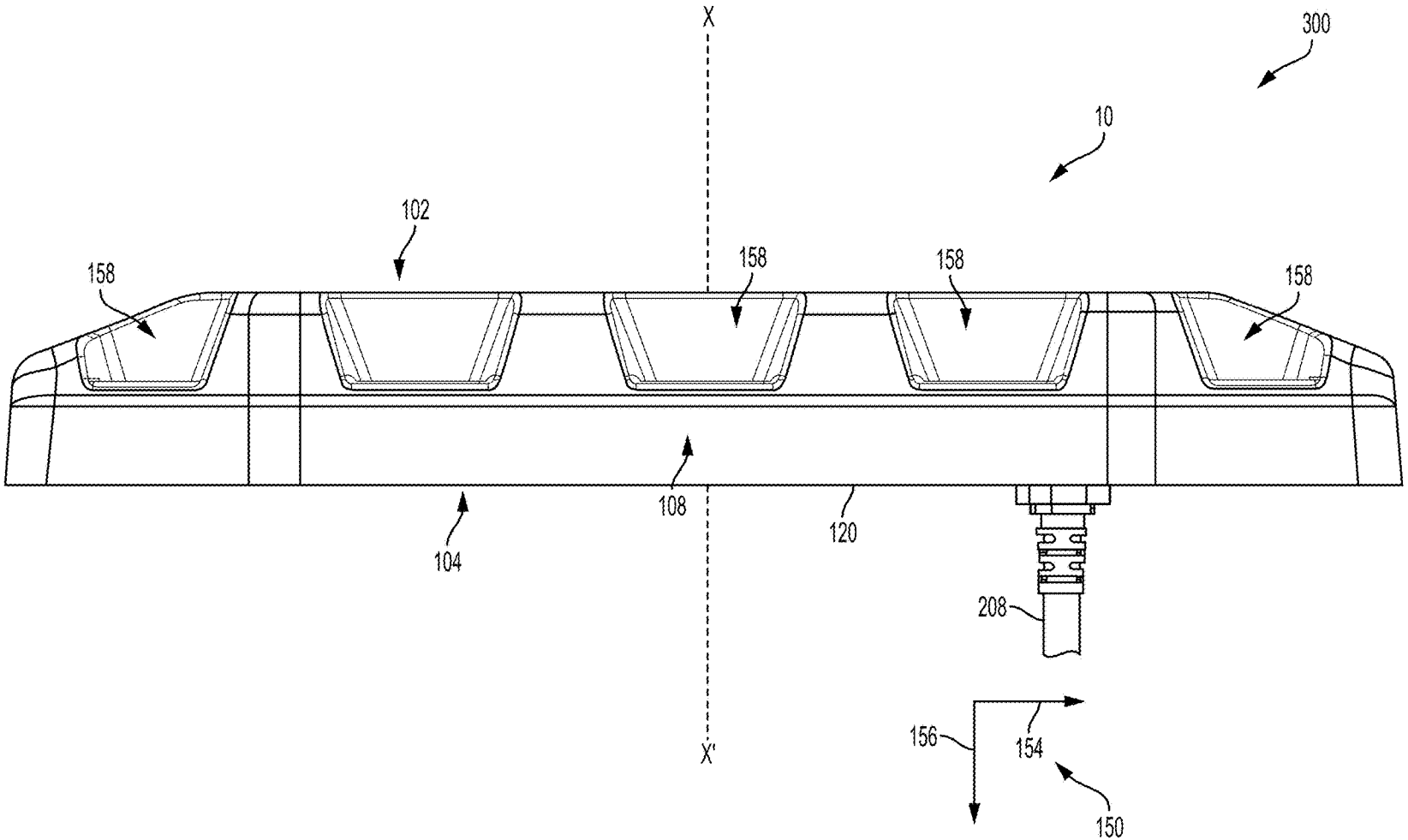
FIG. 3 shows a bottom view of the fairlead of FIG. 1, in accordance with one or more embodiments of the present disclosure.
Figure 4:
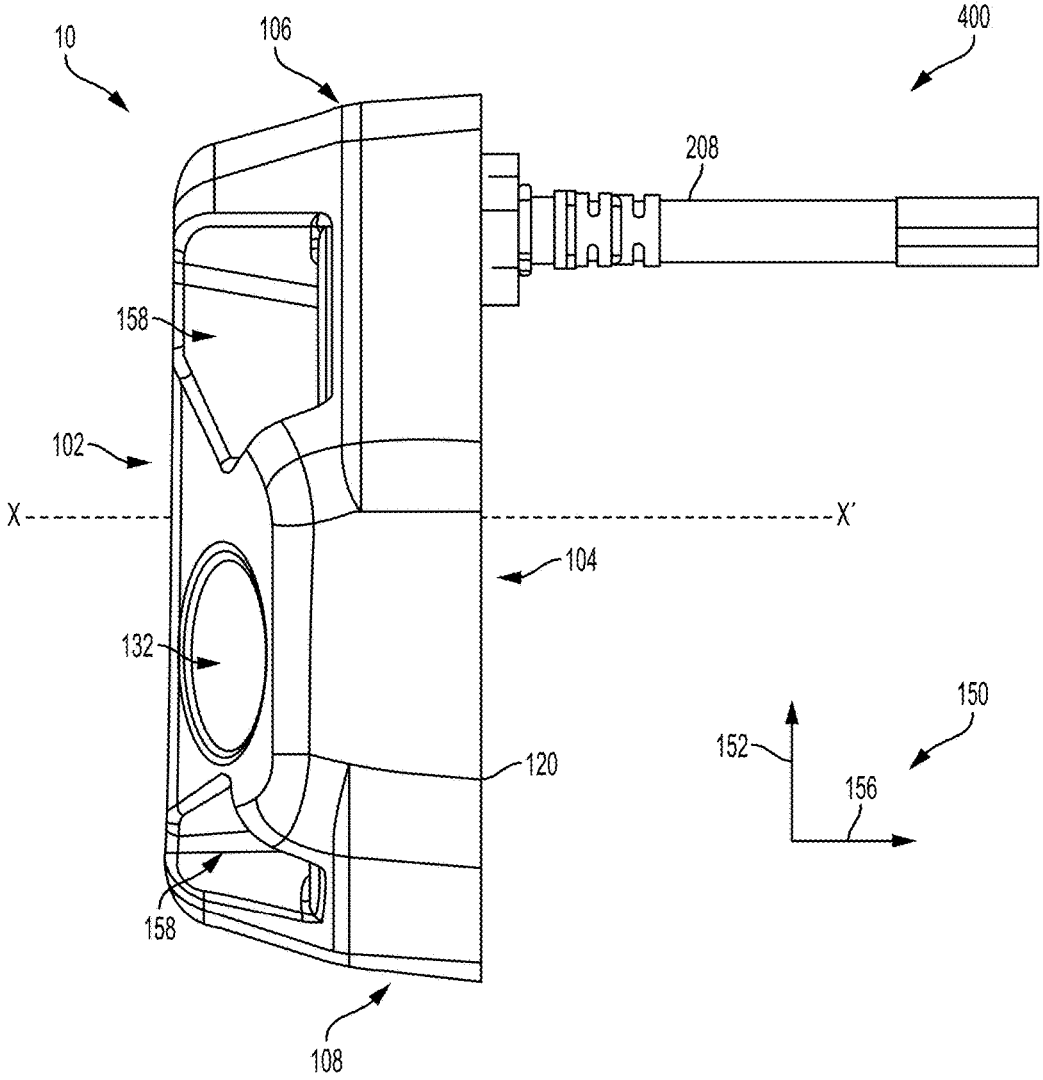
FIG. 4 shows a side view of the fairlead of FIG. 1, in accordance with one or more embodiments of the present disclosure.
Figure 5:
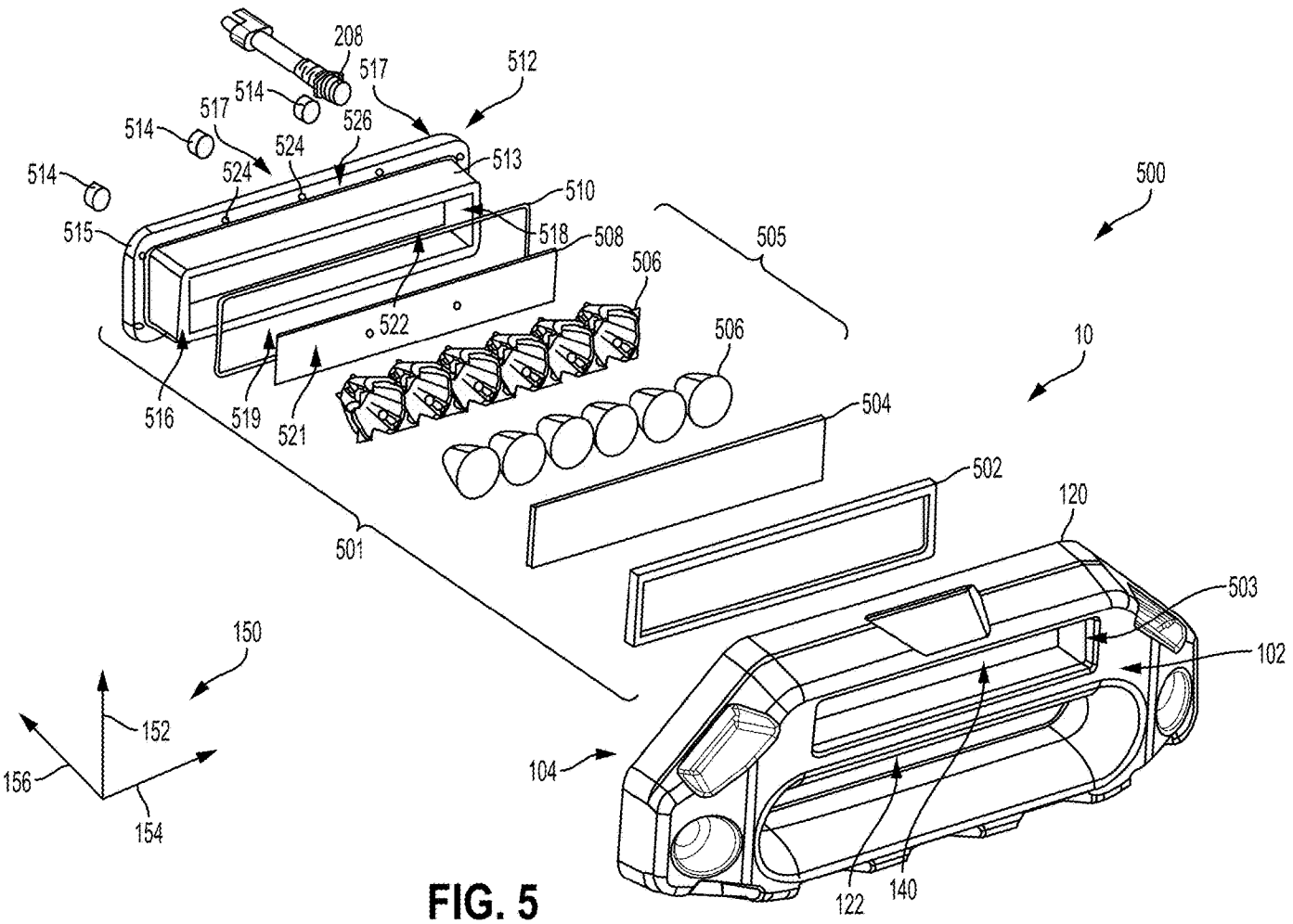
FIG. 5 shows an exploded view of the fairlead of FIG. 1, in accordance with one or more embodiments of the present disclosure.

Turning now to FIGS. 1-5, they show a first example embodiment of the fairlead 10, including a back-loaded integrated lighting system. FIGS. 1-4 show different views of the frame 120 of the first example embodiment of the fairlead 10, while FIG. 5 shows an exploded view of the frame 120 and the back-loaded integrated lighting system.

Figure 1:
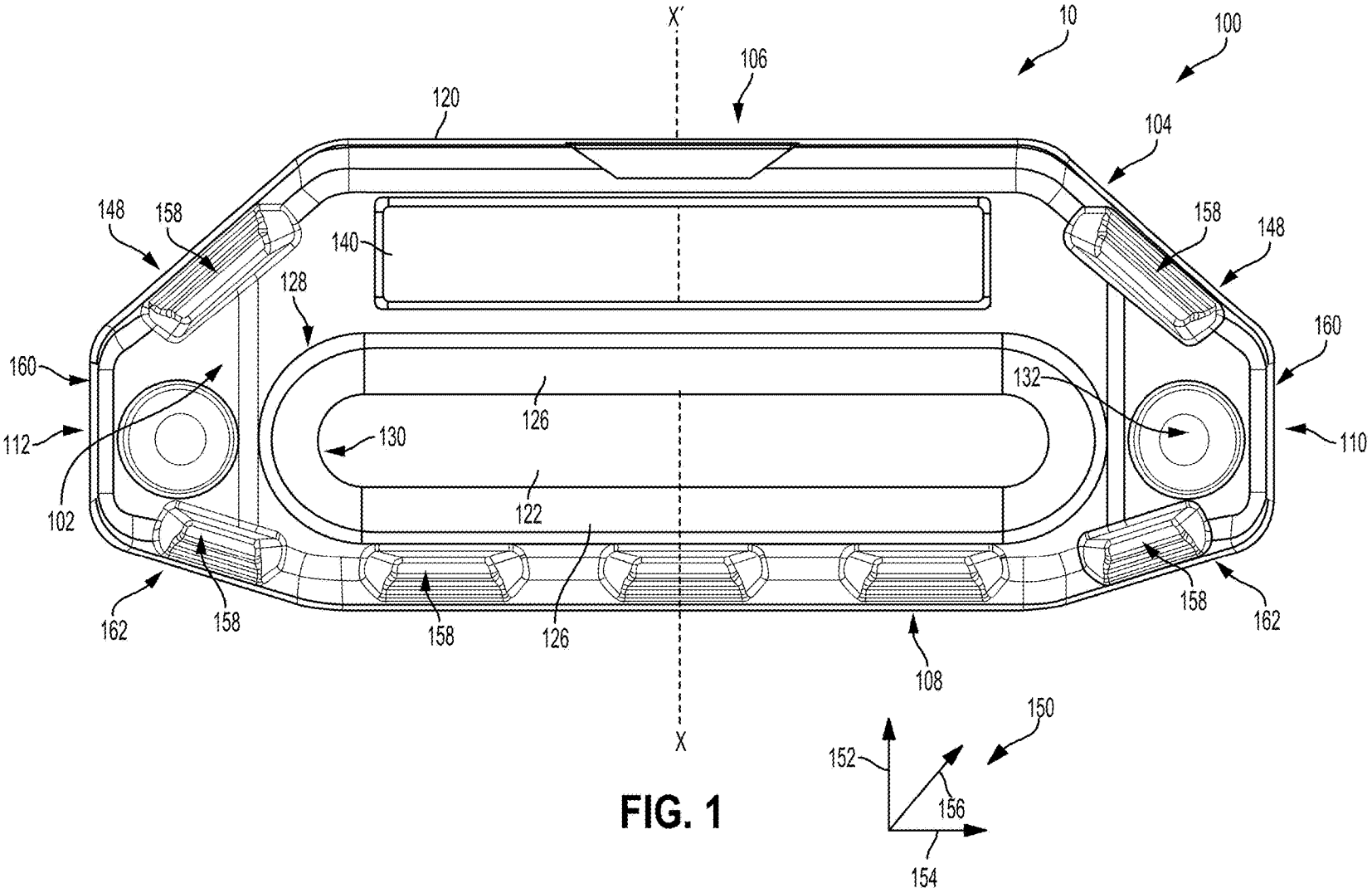
FIG. 1 shows a front view of a fairlead including a first example integrated lighting system, in accordance with one or more embodiments of the present disclosure.

Focusing on FIG. 1, it shows a front view 100 of a fairlead 10. The fairlead 10 comprises a fairlead housing or frame 120. The frame 120 may include a front-facing surface 102 opposite a rear-facing surface 104, a top-facing surface 106 opposite a bottom-facing surface 108, and a first side surface 110 opposite a second side surface 112. As shown in the example of FIG. 1, the side surfaces 110 and 112 may be the same and/or similar size and shape. Further, the side surfaces 110 and 112, may each include three substantially planar edges, where one of the edges of each of the side surfaces 110 and 112 is approximately orthogonal to the top-facing surface 106 and bottom-facing surface 108. However, in other examples, each of the side surfaces 110 and 112 may include more or less than three edges. For example, the side surfaces 110 and 112 may include a single planar edge that connects the top-facing and bottom-facing surfaces 106 and 108, respectively.

In some examples, one or more of the top-facing surface 106 may be parallel the bottom-facing surface, the front-facing surface 102 may be parallel the rear-facing surface 104, and at least one of the edges of the first side surface 110 may be parallel to at least one of the edges of the second side surface 112. A central axis X-X' of the frame 120 is shown in FIG. 1, where the central axis X-X' may be centrally positioned with respect to the frame 120 and may extend through the frame 120 from the front-facing surface 102 to the rear-facing surface 104. Thus, the central axis X-X' may be perpendicular to the front-facing surface 102 and/or rear-facing surface 104. Further, the axis X-X' may pass through a center of the frame 120.

In the description herein, a "thickness" of the fairlead frame 120 may be used to define the physical extent of the frame 120 along the axis X-X.' Thus, the thickness of the frame 120 may refer to the distance between the front-facing surface 102 and the rear-facing surface 104. Further, a "width" of the frame 120 may be used to refer to the distance between the side surfaces 110 and 112, and a "height" of the frame 120 may be used to refer to the distance between the top-facing surface 106 and the bottom-facing surface 108.

The frame 120 includes an aperture or first opening 122 through which a rope and/or cable (not shown in FIG. 1) may extend. Thus, the first opening 122 and frame 120 may restrict lateral movement of a rope and/or cable as the rope and/or cable is pulled through the fairlead 10. The first opening 122 may extend through an entirety of the frame 120, from the front-facing surface 102 to the rear-facing surface 104, such that the rope and/or cable may extend through the fairlead 10.

In some examples, the first opening 122 may be centrally positioned within the frame 120. As such, the first opening 122 may also be referred to herein as central opening 122. Thus, the first opening 122 (e.g., opening 122) may be centered on the central axis X-X.' The opening 122 may therefore be equidistant from the top-facing surface 106 and the bottom-facing surface 108, and/or may be equidistant from the first side surface 110 and second side surface 112. However, it will be appreciated that in other examples the opening 122 may not be centrally positioned within the frame 120. For example, as shown in the example of FIG. 1, the opening 122 may be positioned more proximate the bottom-facing surface 108 than the top-facing surface 106.

The first opening 122 may be defined at the front-facing surface 102 by a first edge 128 and at the rear-facing surface 104 by a second edge 130. Said another way, the front-facing surface 102 may include the first edge 128, where the first edge 128 defines the cross-sectional area of the opening 122 at the front-facing surface 102. Similarly, the rear-facing surface 104 may include the second edge 130, which defines the cross-sectional area of the opening 122 at the rear-facing surface 104. The first edge 128 may also be referred to herein as first perimeter 128, and second edge 130 may be also be referred to herein as second perimeter 130, as the edges 128 and 130 may define the perimeter of cross-sections of the opening 122 at the front-facing surface 102 and rear-facing surface 104, respectively.

In some examples, such as the example shown in FIG. 1, cross-sections of the opening 122, taken along a plane parallel to the plane defined by the rear-facing surface 104 and/or front-facing surface 102, at the front-facing surface 102 and rear-facing surface 104 may define the same or similar shape. Further, in some examples, cross-sections of the opening 122 may define the same or similar shape along the axis X-X' between the front-facing surface and the rear-facing surface 104. Thus, substantially all of the cross-sections of the opening 122 may be concentric. As such, the opening 122 may be symmetric with respect to the central axis X-X.'

Thus, the edges 128 and 130 may define the perimeter of the same or similar shape. However, in other examples, the edges 128 and 130 may define the perimeter of different shapes and the cross-sections of the opening 122 at the front-facing surface 102 and rear-facing surface 104 may define different shapes. In the example shown in FIG. 1, the edges 128 and 130 may define an obround shape, comprising two parallel lines of equal length, connected by semicircular ends. However, the edges 128 and 130 may be shaped differently to define the perimeters of other geometric and non-geometric shapes such as rectangles, rectangles with rounded corners, ovals, ellipses, circles, etc. Thus, the edges 128 and 130 may define an oblong shape with two straight parallel sides connected by curved ends. In some examples, the curved ends of the central opening 122 may have a first diameter at the front-facing surface 102 and a second diameter at the rear-facing surface 104, where the first diameter may be larger than the second diameter. However, in other examples, it will be appreciated that the diameters of the curved ends may be the same and/or similar at the front and rear-facing surfaces 102 and 104, respectively. In yet further examples, the curved ends of the opening 122 may be larger at the rear-facing surface 104 than the front-facing surface 102.

A first perimeter of the first edge 128 may be greater than a second perimeter of the second edge 130, and thus, the cross-sectional area of the opening 122 may be greater at the front-facing surface 102 than at the rear-facing surface 104. In this way, the cross-sectional area of the opening 122 may vary from the front-facing surface 102 to the rear-facing surface. In particular, the cross-sectional area of the opening 122 may monotonically decrease from the front-facing surface 102 to the rear-facing surface 104, such as is shown in the example of FIG. 1. As such, the first opening 122 includes a continuous curved surface 126 that curves outward from the second edge 130 to the first edge 128. Thus, the continuous curved surface 126 may be convex.

However, in other examples, the first perimeter of the first edge 128 may be the same and/or similar to the second perimeter of the second edge 130, and therefore the cross-sectional area of the opening 122 may be approximately the same at the front and rear-facing surfaces 102 and 104, respectively. In such examples, the cross-sectional area of the opening 122 may be relatively constant along the thickness or axis X-X' of the frame 120 (e.g., when moving from the front-facing surface 102 to the rear-facing surface 104). However, in still further examples, the first perimeter of the first edge 128 may be smaller than the second perimeter of the second edge 130, and therefore the cross-sectional area of the opening 122 may be larger at the rear-facing surface 104 than the front-facing surface 102.

In some examples, such as the example shown in FIG. 1, the edge 128 may be flush with the front-facing surface 102. Thus, the edge 128 may be continuous with the front-facing surface 102, and may define an edge of the front-facing surface 102. However, in other examples, the edge 128, may be raised from the front-facing surface 102, such as for example as a raised lip. Thus, in some examples, the edge 128 may be referred to herein as lip 128. In such examples, where the edge 128 is formed as a lip, the central opening 122 may be formed by the lip (e.g., edge 128) in the frame 120 that extends outward from the front-facing surface 102 the frame 120. Thus, in such examples, the continuous curved surface 126 of the central opening 122 may be defined between an inner edge of the lip 128 and the rear-facing surface 104. In yet further examples, the edge 128 may be recessed from the front-facing surface 102 and may form a slot or groove. Thus, in some examples, the edge 128 may be referred to herein as slot 128. In such examples, where the edge 128 is formed as a recessed slot, the central opening 122 may be formed by the recess (e.g., edge 128) in the frame 120 that extends inward from the front-facing surface 102 the frame 120. Thus, in such examples, the continuous curved surface 126 of the central opening 122 may be defined between an inner edge of the lip 128 and the rear-facing surface 104.

Similarly, the edge 130 may be flush with the rear-facing surface 104, such as in the example shown in FIG. 1. Thus, the edge 130 may be continuous with the rear-facing surface 104, and may define an edge of the rear-facing surface 104. However, in other examples, the edge 130, may be raised from the rear-facing surface 104, such as for example as a raised lip. In yet further examples, the edge 130 may be recessed from the rear-facing surface 104.

The fairlead frame 120 may further include one or more bores 132 including a central portion that may extend through an entirety of the frame 120 in the direction of the axis X-X' and an outer portion surrounding the central portion that extends to the front-facing surface of the bore 132 which may be arranged at the front-facing surface 102. Specifically, the central portion may define smaller cross-sectional area than the outer portion, and the outer portion may extend from the front-facing surface 102 of the frame 120 into the frame 120, up to the central portion. The central portion, may then extend from the outer portion to the rear-facing surface 104 of the frame 120. The transition between the central portion and outer portion may be defined by a step. Thus, the bores 132 may extend from the front-facing surface 102 to the rear-facing surface 104. In the description herein, the bores 132 may also be referred to as mounting apertures 132. As shown in the example of FIG. 1, the frame 120 may include two mounting apertures 132, disposed on opposite sides of the opening 122. However, in other examples, the frame 120 may include more or fewer than two bores 132. The bores 132 may be sized to receive fasteners such as bolts, screws, etc., for physically securing the fairlead 10 to a desired structure. Thus, one or more bolts may extend through the bores 132 and fairlead frame 120 and into the desired structure to which the fairlead 10 is to be attached, to physically couple the fairlead 10 to the structure. In one example, an elongated end of the bolt or screw (which may be threaded) may extend through the bore 132 and past the rear-facing surface 104 and an inner side of a head of the bolt or screw may be in face-sharing contact with a front-facing surface of the central portion, and thus the head of the bolt or screw may be arranged within the outer portion of the bore 132. In this way, the head of the bolt or screw may fit within the outer portion of the bore 132, and the elongated end of the bolt or screw may extend through the central portion of the bore 132, and out of the back of the frame 120 through the rear-facing surface 104. In some examples, a front-facing surface of the head of the bolt or screw may be flush with the front-facing surface 102 of the frame 120. However, in other examples, the front-facing surface of the head of the bolt or screw may be recessed or raised relative to the front-facing surface 102 of the frame 120. As one example, the fairlead 10 may be coupled to a winch or to a vehicle in front of the winch, to guide the winch rope and/or cable during winching operation. As another example, the fairlead 10 may be coupled to a hoist to guide the rope and/or cable of the hoist. As yet another example, the fairlead 10 may be coupled to a ship and/or boat for guiding one or more of mooring lines, anchoring cables, etc.

The fairlead frame 120 may be constructed from one or more metals, metal alloys, and/or plastics. In one example, the fairlead frame 120 may be constructed from aluminum. However, in other examples, the fairlead frame 120 may be constructed from one or more of steel, iron, etc. Further, the fairlead frame 120 may be constructed from a single metal element or alloy. However, in other examples, the fairlead frame 120 may be a composite, constructed from a combination of more than one metal element or alloy.

The frame 120 may further include a second opening 140 configured to house an integrated lighting system comprising a plurality of lights. The integrated lighting system may be a lighting system that is included within the frame 120. Thus, the integrated lighting system may not be coupled to an exterior surface of the frame 120. As such, the lights of the integrated lighting system may be fully included within the frame 120 and may not be positioned external to the frame 120. As shown in the examples of FIGS. 1-8, the second opening 140 may be positioned vertically above the opening 122 relative to the vertical axis 152, and/or relative to an orientation of the fairlead 10 when mounted to a pulling structure (such as a winch). Thus, in the description herein, the second opening 140 may also be referred to herein as top opening 140. However, it will be appreciated that in other examples, the second opening 140 may not be located above the opening 122, but rather be spaced away from the opening 122 in another direction. In one example, one or more second openings 140 may be spaced away from and positioned adjacent to opening 122. In other examples, one or more second opening 140 may be positioned vertically below opening 122. In further examples, the one or more second openings 140 may be positioned on one or more sides (e.g., adjacent to opening 122 is a horizontal direction parallel with axis 154).

The second opening 140 may extend through the entirety of the frame 120 from the front-facing surface 102 to the rear-facing surface 104 of the frame 120. However, in other examples, the second opening 140 may extend through only a portion of the frame 120 from the front-facing surface 102. In yet further examples, the second opening 140 may extend from the rear-facing surface 104 through only a portion of the frame 120. In some examples, such as is shown below in the example of FIG. 5, the length of the second opening 140 may be less than the length of the first opening 122. Further, in some examples, the cross-sectional area of the opening 140 may be less than the opening 122. However, in other examples, the cross-sectional area of the opening 140 may be greater than the opening 122.

In some examples, cross-sections of the opening 140 may define a rectangular shape. However, the cross-sections of the opening 140 may be shaped differently to define the perimeters of other geometric and non-geometric shapes such as rectangles with rounded corners, ovals, ellipses, circles, etc. In some examples, the cross-sectional area of the opening 140 may be approximately the same throughout the frame 120, when translating from the front-facing surface 102 to the rear-facing surface 104. However, in other examples, the cross-sectional area of the opening 140 may vary from the front-facing surface 102 to the rear-facing surface 104.

Due to the inclusion of the top opening 140, the edges of the side surfaces 110 and 112 may comprise different lengths. For example top edges 148 of the side surfaces 110 and 112 may be longer than side edges 160 and bottom edges 162 of the side surfaces 110 and 112. The frame 120 may also include one or more recesses 158 on the front-facing surface 102.

Figure 2:
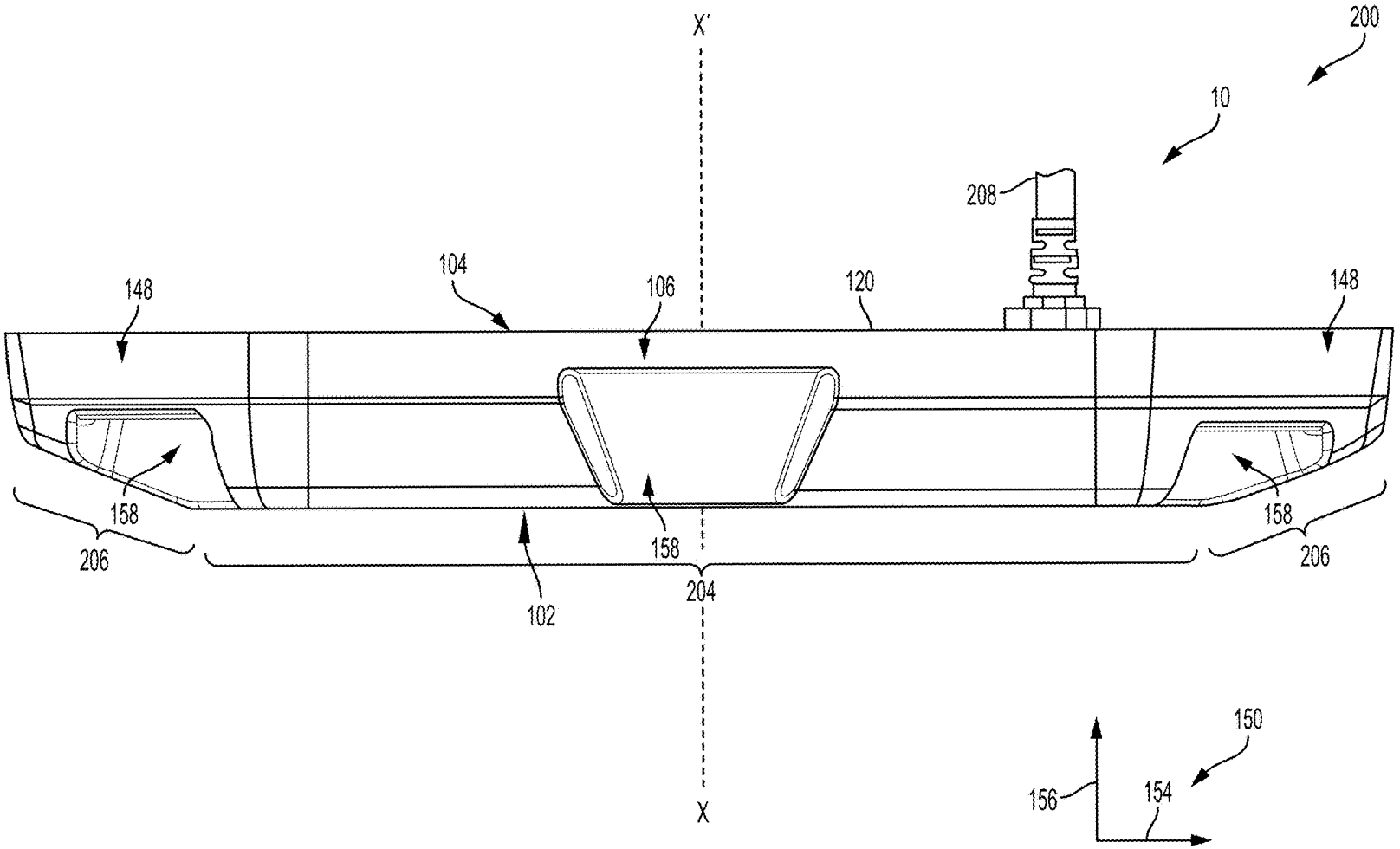
FIG. 2 shows a top view of the fairlead of FIG. 1, in accordance with one or more embodiments of the present disclosure.

Continuing to FIG. 2, it shows a top view 200 of the example embodiment of the frame 120 of the example embodiment of the fairlead 10 described above in FIG. 1. The recesses 158 are recessed from the front-facing surface 102 back towards the rear-facing surface 104. Further, the recesses 158 may be included on the top-facing surface 106 of the frame 120. Thus, the recesses 158 may be included at the corner of the frame 120, where the top-facing surface 106 and front-facing surface 102 meet. Thus, the recesses 158 may be recessed from both the top-facing surface 106 and front-facing surface 102. Thus, the thickness of the frame 120 may be less at the recesses 158, than at areas of the frame 120 not including the recesses 158.

As shown in FIG. 2, a wire harness 208 may be directly coupled to a rear-facing surface 104 of the frame 120. The wire harness 208 may extend into the frame 120 through the rear-facing surface 104. Within the frame 120, the wire harness 208 may be electrically coupled to a circuit board of the fairlead lighting system for supplying electrical current thereto.

As shown in the example of FIG. 2, the front-facing surface 102 may include three substantially planar edges. A front edge 204 may be parallel to the rear-facing surface 104. Two side edges 206 may be angled relative to the front and rear-facing surfaces 102 and 104, respectively.

Turning now to FIG. 3, it shows a bottom view 300 of the example embodiment of the frame 120 of the example embodiment of the fairlead 10 described above in FIGS. 1 and 2. In the example shown in FIG. 3, the recesses 158 are recessed from the front-facing surface 102 back towards the rear-facing surface 104. Further, the recesses 158 may be included on the bottom-facing surface 108 of the frame 120. Thus, the recesses 158 may be included at the corner of the frame 120, where the bottom-facing surface 108 and front-facing surface 102 meet. Thus, the recesses 158 may be recessed from both the bottom-facing surface 108 and front-facing surface 102. It will be appreciated that recesses 158 may also be configured with lights, as part of an integrated lighting system. In one example, each recess 158 may be configured with one or more LED lights. In some examples, one or more recess 158 may be configured with the same or different color lights, and one or more lights of each recess 158 may be adjustable (e.g., able to pivot, rotate, or tilt) so that each light may be aimed as desired by the operator. Further detail regarding aiming of the integrated lighting will be discussed with reference to FIG. 17.

Continuing to FIG. 4, it shows a side view 400 of the example embodiment of the frame 120 described above in FIGS. 1-3. As shown in the example of FIG. 4, the wire harness 208 may be included more proximate the top-facing surface 106 than the bottom-facing surface 108. The wire harness 208 may include one or more electrical wires, and may provide electrical power to a circuit board of the integrated fairlead lighting system as described in greater detail below with reference to FIG. 5.

Moving on to FIG. 5, it shows an exploded view 500 of the fairlead 10 including the example embodiment of the frame 120 described above in FIGS. 1-4, and a back-loaded integrated lighting system 501. The back-loaded integrated lighting system 501 may be included within the second opening 140, and may be loaded into the opening 140 from the rear-facing surface 104 of the frame 120. Thus, the lighting system 501 may be referred to as an integrated lighting system since the lighting system 501 is included within the opening 140 of the frame. As such, the frame 120 houses and includes the lighting system 501. The lighting system 501 may not be coupled to an external surface of the frame 120.

The back-loaded lighting system 501 may include in order from the front-facing surface 102 to the rear-facing surface 104 of the frame 120, one or more of a first gasket 5502, lens 504, lights 505, the lights 5505 including a circuit board 5508 and reflectors 506, a second gasket 5510, a circuit board mount 512, and one or more rear-facing lenses 5514. Thus, the first gasket 502 may be may be in face sharing contact with a rear facing inner surface 503 of the opening 140. The lens 504, reflectors 506, and circuit board 508508 may be included within an interior of a body 513 of the mount 512, where the lens may be positioned in front of (e.g., more proximate the front-facing surface 102 of the frame 120 than) the reflectors 506, and the reflectors 506 may be positioned in front of the circuit board 5508. As described above with reference to FIGS. 2-4, the wire harness 208 may be electrically coupled to the circuit board 5508 for providing electrical power thereto. Thus, one or more wires from the wire harness 208 may extend into the frame 120, and may be physically and/or electrically coupled to the circuit board 508. The wire harness 208 may extend outward from the circuit board 508 in a direction away from a rear-facing surface 104 of the frame 120.

In some examples, the lights 505 may be LEDs. Specifically, the circuit board 508 may be a printed circuit board, and may include one or more LED semiconductors or crystal light sources such as gallium phosphide, aluminum gallium arsenide, gallium arsenide phosphide, silicon carbide, silicon, etc. When an electric field (e.g., electric current) is supplied to the circuit board 508, light may be emitted by the semiconductor light sources in what is commonly referred to as electroluminescence. The reflectors 506 may direct the visible light waves generated by the LED semiconductor light sources, and focus them towards the front-facing surface 102 of the frame 120. It will be appreciated that in other examples, lights other than LEDs may be used such as fluorescent, incandescent, high-intensity discharge, etc. Reflectors 506 may include one or more components, as shown in the example of FIG. 5, but it will be appreciated that reflectors 506 may also be a single component. The depicted example shows six lights 505 with reflectors 506, but it will be appreciated that more or fewer lights and reflectors may be used. In one non-limiting example, one long light with one long reflector may be used. Additionally, it will be appreciated that one or more of the lights 505 and reflectors 506 may be actuatable so an operator may focus the light from each light 505 and reflector 506, or a subset of the lights 505 and reflectors 506 in a desired direction. Further detail with respect to this possible embodiment will be discussed with reference to FIG. 17. The light waves may pass through the lens 504 and out the front of the frame 120.

The first gasket 502 may be in face sharing contact with each of the rear facing inner surface 503 of the second opening 140 of the frame 120, and the lens 504. In particular, the first gasket 502 may be in sealing contact with the rear facing inner surface 503 of the second opening 140, and the lens 504. In this way, the first gasket 502 may provide a seal between the frame 120 and the lens 504. In this way, the gasket 502, lens 504, and body 513 of the mount 512 may provide a seal with respect to the front-facing surface 102 of the frame 120.

However, in other examples, the first gasket 502 may be in face sharing contact with each of the rear facing inner surface 503 and a forward facing outer surface 516 of the body 513 of the circuit board mount 512. Thus, in some examples, the first gasket 502 may be positioned between the mount 512, and the rear facing inner surface 503 of the second opening 140. As such, the gasket 502 may be in sealing contact with the body 513 of the mount 512, and the rear facing inner surface 503 of the second opening 140. However, in other examples, the first gasket 502 may surround the body 513 of the circuit board mount 512. In such examples, the forward facing outer surface 516 of the body 513 may directly contact the rear facing inner surface 503 of the second opening 140.

The forward facing outer surface 516 of the body 513 may be spaced away from an outer flange 515 of the circuit board mount 512. More specifically, the circuit board mount 512, may include the body 513 that extends inwards, into the frame 120, towards the front-facing surface 102, and an outer flange 515 that is in face sharing contact with and physically coupled to the rear-facing surface 104 of the frame 120. The flange 515 may include one or more holes 524 for receiving fasteners such as screws, bolts, etc., for physically coupling the mount 512 to the rear-facing surface 104 of the frame 120. The flange may be raised from the outer surfaces of the body 513, such that the flange 515 has a larger cross-sectional area than the body 513. The forward facing outer surface 516 of the body 513, may be the front end of the mount 512, and thus may be the most inwardly projecting part of the mount 512. The body 513 includes an opening 522 defined by inner surfaces 518 of body 513. Opening 522 may also be referred to herein as mount central opening 522.

The lights 505, including the circuit board 508 and reflectors 506 may be positioned behind the lens 504. The lens 504, and lights 505 may be positioned within the opening 522. In particular, the lights 505 may be fully included within the opening 140 of the frame 120. Thus, no portion of the lights 505 may be positioned exterior to the frame 120, when the lighting system 501 is assembled within the frame 120. Further, the lights 505 may not be coupled to an exterior surface of the frame 120 (e.g., front-facing surface 102 and rear-facing surface 104) and may be coupled to an interior surface (e.g., interior walls of opening 140).

In some examples, the gasket 502 may surround the edges of the lens 504, and thus may form a border around the lens 504. Further, the circuit board 508 may be physically coupled to a rear surface 517 of the mount 512. Specifically, a rear surface 519 of the circuit board 508 may be coupled to an interior of the rear surface 517 of the mount 512. The mount 512 may be closed at the back or rear surface 517. Thus, the mount 512 may be closed at the back edge of the flange 515. However, in other examples, the rear surface 517 may be closed except for one or more cut-outs, sized and shaped to receive one or more rear lenses 514. Thus, the rear lenses 514 may be received within the rear surface 517 of the mount 512, and as such, light from the circuit board 508 may be emitted out the back end of the fairlead 10, from the rear-facing surface 104. By including rear lenses 514, visible light from the lights 505 may be directed backwards towards the structure to which the fairlead 10 may be coupled.

Thus, in some examples, the circuit board 508 may include a plurality of LED semiconductor or crystal light sources on a front surface 521, and a second set of LED semiconductor or crystal light sources on the rear surface 519, the front surface 521 opposite the rear surface 519. The LED semiconductor or crystal light sources on the front surface 521 may propagate light towards the front-facing surface 102, and out of the frame 120 via the lens 504. Similarly, the LED semiconductor or crystal light sources on the rear surface 519 of the circuit board 508 may propagate light towards the rear-facing surface 104, and out of the frame 120 via the rear lenses 514. Thus, the first set of LED semiconductor or crystal light sources on the front surface 521, and second set of LED semiconductor or crystal light sources on the rear surface 519 may propagate light in approximately opposite directions. Circuit board 508 may be disposed within the second opening 140 and outer edges of the circuit board 508 may be in face sharing contact with inner walls (e.g., inner surfaces 518) of the frame which form the second opening 140. The plurality of lights may comprise the circuit board and a plurality of reflectors, the circuit board including a first set of LED semiconductor light sources (e.g., lights and reflectors 506) on a front first surface 521 and a second set of LED semiconductor light sources (e.g., rear lenses 514) on a rear second surface, the rear second surface of the circuit board opposite the front first surface of the circuit board 508. In other words the circuit board 508 further includes a second set of LED semiconductor light sources on a rear second surface, the rear second surface of the circuit board 508 opposite the front first surface 521 of the circuit board 508, and where light generated by the second set of LED semiconductors passes through the rear-facing lenses 514 and out of the rear-facing surface of the frame 104. In this way, rear lenses 514 may serve to provide aesthetically pleasing backlighting of the fairlead.

In some examples, when the integrated lighting system 501 is assembled within the opening 140, and the mount 512 is coupled to the frame 120, the rear surface 517 of the mount 512 may be approximately flush with the rear-facing surface 104 of the frame 120. However, in other examples, the rear surface 517 may be raised or recessed relative to the rear-facing surface 104 of the frame 120. The circuit board 508 may be disposed within the mount central opening 522 in front of the rear surface 517 of the mount 512. Further, when the lighting system 501 is assembled within the opening, and the mount 512 is coupled to the frame 120, outer edges of the circuit board 508 may be in face sharing contact with inner surfaces 518 of the circuit board mount 512. The mount 512 may comprise a thermally conductive material such as a metal. By positioning the circuit board 508 in face sharing contact with the mount 512, heat may be dissipated from the circuit board, through the mount 512, and into the frame 120, via conduction. Thus, an amount of heat dissipated from the circuit board 508 may be increased by positioning the circuit board 508 in contact with thermally conductive materials of the mount 512 and/or frame 120.

The reflectors 506 may be mounted within the mount central opening 522 of the circuit board mount 512, in front of the circuit board 508, with respect to the front-facing surface 102 of the frame 120. In some examples, the plurality of reflectors 506 surround the plurality of LED semiconductor materials included on the circuit board 508. In particular, the reflectors 506 and LED semiconductor materials of the circuit board 508 may be arranged in a line along the second opening 140. Thus, the lights 505 may be arranged along a line parallel to the lateral axis 154 across the opening 140. However, in other examples, the reflectors 506 and LED semiconductor materials of the circuit board 508 may be arranged in another manner within the opening 140 such as in a grid, array, columns, rows, or other patterns.

The second gasket 510 may be positioned around a perimeter of the outer surface of the body 513 of the circuit board mount 512. Further, the second gasket 510 may be positioned between and/or in face sharing contact with each of a forward facing surface 526 of the outer flange 515 and the rear-facing surface 104 of the frame 120, around the second opening 140. Thus, the second gasket 510 may surround the body 513, and may be in sealing contact with the body 513 and rear-facing inner surface 503 of the second opening 140. In this way, the second gasket 510 may provide a seal between the rear-facing surface 104 of the frame 120, and the mount 512.

Turning now to FIGS. 6-7, they show a second example embodiment of a fairlead 650, including a front-loaded integrated lighting system 601. Thus, in the examples of FIGS. 6 and 7, the front-loaded integrated lighting system 601 may be loaded into an opening 640 that may be similar to opening 140 (shown in FIGS. 1-5) of the frame 620 through the front-facing surface 609 of the frame 620, instead of through rear-facing surface 611 (which may be similar to rear-facing surface 104, as is described above with reference to FIGS. 1-5). FIG. 6 shows a front view of the frame 620 of a second example embodiment of a fairlead with an integrated lighting system, while FIG. 7 shows an exploded view of the frame 620 and the front-loaded integrated lighting system 601.

Focusing now on FIG. 6, it shows a front view 600 of a second example embodiment of the frame 620 of the second example embodiment of a fairlead. It will be appreciated that in some examples, frame 620 may be similar or share features with frame 120, as described with reference to FIGS. 1-5. Frame 620 is configured to house a front-loaded integrated lighting system 601. In particular, front view 600 shows a view of the fairlead 650, fully assembled, with the front-loaded integrated lighting system 601 already loaded into the frame 620.

As such, opening 640 (which may be similar to 140 described above with reference to FIGS. 1-5) may not be visible in FIG. 6, as a bezel 602 of the front-loaded integrated lighting system 1001 is covering the opening 640. In some examples, the bezel 602 may be flush with the front-facing surface 609 of the frame 620, when the front-loaded integrated lighting system 601 is assembled. Specifically, a front surface 603 of the bezel 602 may be flush with the front-facing surface 609 of the frame 620. However, in other examples, the front surface 603 of the bezel 602 may be recessed or raised relative to the front-facing surface 609 of the frame 620. The bezel 602 may retain components of the front-loaded integrated lighting system 601 within the frame 620, and/or may provide a seal with the front-facing surface 609 of the frame 620.

The bezel 602 may be physically secured to the front via fasteners such as bolts, screws, etc. As such, the bezel 602 may include a plurality of holes 604 positioned proximate a perimeter of the bezel 602 for receiving the fasteners. FIG. 6, shows a plurality of fasteners 606 extending through the holes 604 of the bezel, into the frame 620, for physically securing the bezel and lighting system 601 to the frame 620 of the fairlead 650. It will be appreciated that more or fewer fasteners may be used. However, in other examples, the bezel 602 may be physically secured via an adhesive. It will be appreciated that any suitable method of coupling the bezel 602 to the frame 620 may be used.

Moving on to FIG. 7, it shows an exploded view 700 of the second example embodiment of the fairlead 650 including the frame 620 and front-loaded lighting system 601. The front-loaded integrated lighting system 601 may be included within the second opening 640, and may be loaded into the opening 640 from the front-facing surface 609 of the frame 620.

In the example shown in FIG. 7, the second opening 640 extends into the frame 620 from the front-facing surface 609, but may not extend through the entirety of the frame 620. Thus, the second opening 640 may extend up to the rear-facing surface 730 of the frame 620, but the rear-facing surface 730 of the frame 620 may be closed with the exception of one or more cut-outs 720 sized and configured to receive one or more rear lenses 712 and/or a wiring harness 702. It will be appreciated that the example embodiment of wiring harness 702 may be similar or share similar features to the example embodiment of wiring harness 208, as referenced by FIGS. 2-5. In this way, the second opening 640 may form a cavity in the frame 620 with an opening in the plane of the front-facing surface 609 to receive the front-loaded light system 601. Thus, a back of the opening 640 may be defined by an interior back surface 718 of the back of the frame 620. The interior back surface 718 may cover the second opening 640 at the rear-facing surface 730 of the frame 620.

Further, the opening 640 of the frame 620 may include a central opening portion 716 and a lip portion 714. As shown in the example of FIG. 7, the central opening portion 716 may include four relatively, flat planar walls, defining an opening that has an approximately rectangular cross-section. The central opening portion 716 may extend from the interior back surface 718 that defines the back of the opening 640, up to the lip portion 714. Further, the lip portion 714, may similarly include four relatively flat planar edges, defining an opening that has approximately rectangular cross-section. However, the cross section defined by the lip portion 714 may be greater than that of the central opening portion 716. Further, the thickness of the central opening portion 716 may be greater than that of the lip portion 714. Thus, the physical extent of the central opening portion 716 between the front-facing surface 609 and rear-facing surface 730 may be greater than that of the lip portion 714. Further, the lip portion 714 may extend into the frame 620 from a forward slot portion 724 of the opening 640 up to the central opening portion 716, and may transition to the central opening portion 716 via a step.

The cross-section of the opening 640 may be greater at the forward slot portion 724, than at the lip portion 714 and central opening portion 716. The forward slot portion 724 may be positioned more proximate the front-facing surface 609 than the lip portion 714 and central opening portion 716, where the lip portion 714 may be positioned more proximate the front-facing surface 609 than the central opening portion 716. In the description herein, forward slot portion 724 may also be referred to as first portion 724, lip portion 714 may be referred to herein as second portion 714, and central opening portion 716 may be referred to as third portion 716. Thus, the cross-sectional area of the opening 640 may monotonically decrease when translating from the front-facing surface 609 to the rear-facing surface 730, where the cross-sectional area of the opening 640 may be defined by the first portion 724, second portion 714, and third portion 716.

The front-loaded lighting system 601 may include in order from the front-facing surface 609 to the rear-facing surface 730 of the frame 620, one or more of the bezel 602, a gasket 732, lens 734, lights 735, the lights 735 including a circuit board 738 and reflectors 736, and one or more rear lenses 712. The circuit board 738 may be the same or similar to circuit board 508 described above with reference to FIG. 5, the reflectors 736 may be the same or similar to reflectors 506 described above with reference to FIG. 5, and the lenses 734 and 712 may be the same or similar to lenses 504 and 514, respectively, described above with reference to FIG. 5. Thus, a first set of LED semiconductor or crystal light sources may be coupled to a front surface 721 of the circuit board 738 and may project visible light towards the front-facing surface 609 and out of the front of the frame 620 via the reflectors 736 and lens 73734, and a second set of LED semiconductor or crystal light sources may be coupled to a rear surface 719 of the circuit board, opposite the front surface 721, and may project visible light towards the rear-facing surface 730 and out of the back of the frame 620 via the lenses 712.

The lights 735 may be fully included within the opening 640 of the frame 620. Thus, no portion of the lights 735 may be positioned exterior to the frame 620, when the lighting system 601 is assembled within the frame 620. Further, the lights 735 may not be coupled to an exterior surface of the frame 620 (e.g., front-facing surface 609 and rear-facing surface 730) and may be coupled to an interior surface (e.g., interior walls of opening 640).

Further, the reflectors 736 and LED semiconductor materials of the circuit board 738 may be arranged in a line along the second opening 640. Thus, in some examples, the lights 735 may be arranged along a line parallel to the lateral axis 154 extending across the opening 640. However, in other examples, the reflectors 736 and LED semiconductor materials of the circuit board 738 may be arranged in another manner within the opening 640 such as in a grid, array, columns, rows, or other patterns.

In some examples, the circuit board 738 may be in face-sharing contact with the interior back surface 718 of the frame 620. Specifically, the rear surface 719 of the circuit board 738 may be in face-sharing contact with the back surface 718 of the frame 620. Additionally or alternatively, outer edges of the circuit board 738 may be in face-sharing contact with interior walls of the frame 620 in the opening 640. Specifically, the circuit board 738 may be positioned within the central opening portion 716 of the opening 640 of the frame 620, and thus may physically contact the interior walls of the frame 620 at the central opening portion 716 of the opening 640 via the outer edges of the circuit board 738. By positioning the circuit board 738 in face sharing contact with the frame 620, heat may be dissipated from the circuit board 738 directly into the frame 620, via conduction. Thus, an amount of heat dissipated from the circuit board 738 may be increased by positioning the circuit board 738 in contact with the thermally conductive frame 620.

The rear lenses 712 may be positioned within the cut-outs 720 on the back of the frame 620, and in some examples, may be flush with the rear-facing surface 730 of the frame 620. Further, the rear lenses 712 may be flush with the interior back surface 718 of the opening 640. In this way, objects behind the fairlead 650 may be illuminated by powering on the lights 735. Additional cut-outs 722 may be provided to accept wiring harness 702.

As described above with reference to FIG. 5, the reflectors 736 may be positioned in front of the circuit board 738, and the lens 734 may be positioned in front of the reflectors 736. In some examples, the circuit board 738, reflectors 736, and lens 734 may be positioned within the central opening portion 716 of the opening 640 of the frame 620. The gasket 732 may be positioned between the lens 734 and the bezel 602. As such, the gasket 732 may be in sealing contact with the lens 734 and the bezel 602 and may form a seal with the lens 734 and bezel 602. Thus, the bezel 602, gasket 732, and lens 734 may form a seal with the front-facing surface 609 of the frame 620. As such, the lighting system 601 may be in sealing contact with the front-facing surface 609 of the frame 620.

In some examples, outer edges of the gasket 732 may physically contact inner edges of the lip portion 714 of the opening 140. In such examples, the gasket 732 may be positioned in the opening 140 at the lip portion 714 and may physically contact a front-facing surface of the central opening portion 716. Thus, the gasket 732 may abut the central opening portion 716. In this way, a front-facing surface of the gasket 732 may physically contact a rear surface 743 of the bezel, and the rear-facing surface of the gasket 732, opposite the front-facing surface may physically contact the front-facing surface of the central opening portion 716.

However, in other examples, the gasket 732 may be positioned within the central opening portion 716, and outer edges of the gasket 732 may physically contact inner surfaces of the central opening portion 716 of the opening 140. In such examples, a front-facing surface of the gasket 732 may physically contact a rear surface 743 of the bezel 602, and the rear-facing surface of the gasket 732, opposite the front-facing surface may physically contact the lens 734.

In yet further examples, the gasket 732 may be positioned in the first portion 724 between the lip portion 714 and the bezel 602. Thus, in such examples, the gasket 732 may abut the lip portion 714. In this way, a front-facing surface of the gasket 732 may physically contact the rear surface 743 of the bezel 602, and the rear-facing surface of the gasket 732, opposite the front-facing surface may physically contact the front-facing surface of the lip portion 714.

In examples, where the gasket 732 is not positioned between the bezel 602 and the lip portion 714, the rear surface 743 of the bezel 602 may physically contact the front-facing surfaces of the lip portion 714 of the opening 140. Thus, the front surface 603, opposite the rear surface 743, may be flush with the front-facing surface 102 of the frame 120. The bezel 602 may therefore extend into the opening 140 along the first portion 724. Thus, the bezel 602 may fit within the first portion 724 of the opening 140, and may physically contact the front-facing surfaces of the lip portion 714. In some examples, the front-facing surface of the lip portion 714 and/or front-facing surfaces of the central opening portion 716 may be parallel to the front-facing surface 102 of the frame 120.

The lip portion 714, may further include one or more grooves 715 along the inner edges, for receiving the fasteners 606. Further, the central opening portion 716 may include one or more holes 717 on a front-facing surface of the central opening portion 716 for receiving the fasteners 606. The fasteners 606 may extend past the grooves 715 and into the holes 717 to physically couple the bezel 602 to the frame 120, and thereby retain the components of the integrated lighting system 1001 within the frame 120.

Turning now to FIG. 8, it shows a front perspective view 800 of an embodiment of a fairlead 850, where the fairlead 850 is configured as a roller fairlead including an integrated lighting system. Thus, although FIGS. 1-7 show the integrated lighting system included within a hawse fairlead (e.g., fairlead 10 and fairlead 650), it will be appreciated that the integrated lighting system may also be included in a roller fairlead, such as is shown in the example of FIG. 8.

In the example of FIG. 8, the fairlead 850 may include four rollers: a pair of first rollers 8802, and a pair of second rollers 804. The second rollers 804 may be shorter than the first rollers 802 as depicted in the example of FIG. 8. However, in other examples, the rollers 802 and 804 may be approximately the same length, while in other examples, the second rollers 804 may be longer than the first rollers 802. The first rollers 802 may be positioned more proximate the rear-facing surface 806 of the frame 820, than the second rollers 804. Further, the first rollers 802 may be positioned at the rear-facing surface 806 of the frame 820. Thus, the first rollers 802 may be positioned behind the second rollers 804. In other examples, the first rollers 802 may be positioned in front of the second rollers 804. Further, it will be appreciated that the fairlead 10 may include two rollers that includes one of the pair of first rollers 802 or the pair of second rollers 804.

The rollers 802 and 804 may rotate about respective rotational axes. The second rollers 804 may be positioned parallel to one another such that their rotational axes are parallel to one another. Further, the rollers 804 may be spaced a distance apart from one another. In particular, the rollers 804 may be spaced vertically away from one another, such that one of the rollers 804 is positioned vertically above the other. Thus, the distance between the rollers 804 may define the height of the opening 822. Similarly, the first rollers 802 may be positioned parallel to one another such that their rotational axes are parallel to one another. Further, the rollers 802 may be spaced a distance apart from one another. In particular, one of the rollers 802 may be positioned proximate the first side 810, while the other one of the rollers 802 may be positioned proximate the second side 814. The distance between the rollers 802 may define the height of the opening 822. Similarly, the distance between the rollers 804 may define a width of the opening 822.

Thus, the perimeter or cross-sectional area of the opening 822 may be the area defined between the rollers 802 and 804. A rope and/or cable may extend through the opening 822 between the rollers 802 and 804. The rope and/or cable may contact the surfaces of the rollers 802 and 804, and as the rope moves through the frame substantially along the axis X-X,' the rollers 802 and/or 804 may rotate.

The second opening 840 may be included in the frame 820 above the first opening 822 and rollers 802 and 804. The second opening 840 may house an integrated lighting system, such as either of the integrated lighting systems 501 and 601 described above with reference to FIGS. 5-7. Thus, an integrated lighting system may be included in the frame 820 of a roller fairlead such as the embodiment of the fairlead 850 shown in FIG. 8.

As described above with reference to FIGS. 1 and 5, the second opening 840 (which may be similar to the second opening 140 of FIG. 1 and second opening 640 of FIGS. 6-7) may extend through an entirety of the frame 820 from the front-facing surface 82 to the rear-facing surface 806, in examples where the fairlead 850 includes the back-loaded embodiment of the integrated lighting system. However, in other examples, the second opening 840 may not extend through an entirety of the frame 820. For example, the opening 640 may extend from the front-facing surface 812 inwards towards the rear-facing surface 806, but may not extend fully to the rear-facing surface 806, such as in examples where the fairlead 850 includes the front-loaded embodiment of the integrated lighting system. In yet further examples, the opening 840 may extend from the rear-facing surface 806 inwards towards the front-facing surface 812, but may not extend fully to the front-facing surface 812, such as in examples where the fairlead 850 includes the back-loaded embodiment of the integrated lighting system. In this way, an integrated lighting system, such as lighting systems 501 and 601 described above with reference to FIGS. 5-7, may be included in a roller fairlead, such as the embodiment of the fairlead 850 shown in FIG. 8.

Turning now to FIG. 9, it shows a front perspective view 900 of an embodiment of a fairlead 950, where the fairlead 950 is configured as a roller fairlead including an integrated lighting system. Fairlead 950 may be similar to or have features similar to fairlead 850, as shown in FIG. 8. In the depicted example of FIG. 9, the fairlead 950 may include two rollers: a pair of rollers 902. It will be appreciated in one non-limiting example, rollers 902 may be identical to the pair of rollers 802, as described with reference to FIG. 8, but that fairlead 950 may also be configured with a pair of rollers similar to the pair of rollers 804, as shown in FIG. 8. Specifically, fairlead 950 may be configured with a pair of rollers oriented with cylindrical roller axes parallel to axis 154, or configured with a pair of rollers oriented with their cylindrical roller axes parallel to axis 152. Other roller configurations have been contemplated. An opening 922 is defined as the area between the surfaces of the rollers 902 that face each other and a first surface 912 and a second surface 914 of the frame 920. Opening 922 may be used for passing a winch cable or rope through, as previously described with reference to opening 122 of FIG. 1. In the embodiment shown in FIG. 9, a front-loaded integrated lighting system is not shown for clarity, but a second opening 940 is shown. Second opening 940 is configured to accept a front-loaded integrated light assembly as previously described. In the example shown in FIG. 9, fairlead 950 may include an upper frame 920 and a lower frame 921. It will be appreciated that the upper frame 920 and the lower frame 921 may be coupled together using bolts, adhesives, weldment, or other suitable fasteners. Fasteners (not shown) may couple the upper frame 920 and the lower frame via one or more aperture 942 in the upper frame 920. Aperture 942 may have a corresponding aperture (not shown) in the lower frame 921 for receiving the fastener. In embodiments that include weldments and/or adhesives, these may be located along all or part of the surfaces of upper frame 920 and lower frame 921 that are in face-sharing contact when coupled. Alternatively, the upper frame 920 and the lower frame 921 may be formed as one component (e.g., forged). The second opening 940 may extend into the upper frame 920 from the front-facing surface 909, but may not extend through the entirety of the upper frame 920. Thus, the second opening 940 may extend up to the rear-facing surface 908 of the upper frame 920, but the rear-facing surface 908 of the upper frame 920 may be closed, forming an interior back surface 919 of the second opening 940. In the depicted example, interior back surface 919 may include one or more cut-outs 927, each cut-out 927 suitably sized and configured to receive one or more rear lenses and/or a wiring harness, such as rear lenses 712 and wiring harness 702 of FIG. 7. It will be appreciated that cut-outs 927 may be in any suitable quantity, and of any suitable size to receive lenses, a wiring harness, or other suitable component. In this way, the second opening 940 may form a cavity in the frame 920 with an opening in the plane of the front-facing surface 909 to receive a front-loaded light system, such as front-loaded light system 601, as shown and described in reference to FIGS. 6 and 7. A bezel 903, is also shown in FIG. 9. It will be appreciated that the configuration and mounting method of bezel 903 may be identical or similar to that of bezel 602, as described with reference to FIGS. 6 and 7. It will be appreciated that the example embodiment in FIG. 9 may also include one or more integrated light systems, with light system components and features similar to those of integrated light system 601 of FIGS. 6 and 7. The integrated light system may be segmented into one or more components, each component integrated into the upper frame 920 and/or lower frame 921 at different locations on the fairlead 950. In one example, lights may be integrated into one or more of a first side 925 of lower frame 921 and a second side 926 of lower frame 921.

Turning now to FIG. 10, it shows a front perspective view 1000 of an embodiment of the fairlead 1050, where the fairlead 1050 is configured as a roller fairlead including an integrated lighting system. Fairlead 1050 may be similar to or have features similar to fairleads 850 and 950, as shown in FIGS. 8 and 9, respectively. In the example shown in FIG. 10, fairlead 1050 may include an upper frame 1020 and a lower frame 1021. It will be appreciated that the upper frame 1020 and the lower frame 1021 may be coupled together using bolts, adhesives, weldment, or other suitable fasteners. Fasteners (not shown) may couple the upper frame 1020 and the lower frame via one or more aperture 1042 in the upper frame 1020. Aperture 1042 may have a corresponding aperture (not shown) in the lower frame 1021 for receiving the fastener. In embodiments that include weldments and/or adhesives, these may be located along all or part of the surfaces of upper frame 1020 and lower frame 1021 that are in face-sharing contact when coupled. Alternatively, the upper frame 1020 and the lower frame 1021 may be formed as one component (e.g., forged). A second opening 1040 may extend into the upper frame 1020 from the front-facing surface 1009, but may not extend through the entirety of the upper frame 1020. Thus, the second opening 1040 may extend up to the rear-facing surface 1008 of the upper frame 1020, but the rear-facing surface 1008 of the upper frame 1020 may be closed, forming an interior back surface 1019 of the second opening 1040. In the depicted example, interior back surface 1019 may include one or more cut-outs 1027, each cut-out 1027 suitably sized and configured to receive one or more rear lenses and/or a wiring harness, such as rear lenses 712 and wiring harness 702 of FIG. 7. It will be appreciated that cut-outs 1027 may be in any suitable quantity, and of any suitable size to receive lenses, a wiring harness, or other suitable component. In this way, the second opening 1040 may form a cavity in the upper frame 1020 with an opening in the plane of the front-facing surface 1009 to receive a front-loaded light system, such as front-loaded light system 601, as shown and described in reference to FIGS. 6 and 7. Thus, the upper frame 1020 may be referred to a housing of the lighting system which is coupled to the lower frame 1021 of the fairlead. A bezel 1003, is also shown in FIG. 10. It will be appreciated that the configuration and mounting method of bezel 1003 may be identical or similar to that of bezel 602, as described with reference to FIGS. 6 and 7. It will be appreciated that the example embodiment in FIG. 10 may also include one or more integrated light systems (not shown), with light system components and features similar to those of integrated light system 601 of FIGS. 6 and 7. It will be appreciated that the integrated light system for fairlead 1050 may be segmented into one or more components, each component integrated into the upper frame 1020 and/or lower frame 1021 at different openings (e.g., second opening 1040) on the fairlead 1050. In one example, lights may be integrated into an opening located on one or more of a first side 1025 of lower frame 1021 and a second side 1026 of lower frame 1021. It will be appreciated that lights may also be integrated into the lower frame 1021 of fairlead 1050, below rollers 1002.

Fairlead 1050 includes four rollers: a pair of first rollers 1002, and a pair of second rollers 1004. The second rollers 1004 may be shorter than the first rollers 1002 as depicted in the example of FIG. 10. However, in other examples, the rollers 1002 and 1004 may be approximately the same length, while in other examples, the second rollers 1004 may be longer than the first rollers 1002. The first rollers 1002 may be positioned more proximate the rear-facing surface 1008 of an upper frame 1020, than the second rollers 1004. Further, the first rollers 1002 may be positioned at the rear-facing surface 1008 of the upper frame 1020. Thus, the first rollers 1002 may be positioned behind the second rollers 1004. In other examples, the first rollers 1002 may be positioned in front of the second rollers 1004. Further, it will be appreciated that the fairlead 1050 may include two rollers that includes one of the pair of first rollers 1002 or the pair of second rollers 1004, as shown in FIG. 9. The configuration and function of a dual roller system, as shown in FIG. 10, was described in detail with reference to FIG. 8, and as such will not be duplicated here. It will be appreciated that the rollers 1002 and 1004 may operate similarly to those of FIG. 8.

The distance between the rollers 1002 may define the height of the first opening 1022. Similarly, the distance between the rollers 1004 may define a width of the first opening 1022. Thus, the perimeter or cross-sectional area of the first opening 1022 may be the area defined between the rollers 1002 and 1004. A rope and/or cable may extend through the first opening 1022 between the rollers 1002 and 1004. The rope and/or cable may contact the surfaces of the rollers 1002 and 1004, and as the rope moves through the frame substantially along an axis, similar to the X-X' axis shown in FIG. 8, the rollers 1002 and/or 1004 may rotate.

The second opening 1040 may be included in the upper frame 1020 above the first opening 1022 and rollers 1002 and 1004. The second opening 1040 may house an integrated lighting system, such as the front-loaded integrated light system 601 described above with reference to FIGS. 6-7. Thus, an integrated lighting system may be included in the upper frame 1020 of a roller fairlead such as the embodiment of the fairlead 1050 shown in FIG. 10.

Turning now to FIG. 11, it shows a front perspective view 1100 of an embodiment of the fairlead 1150, where the fairlead 1150 is configured as a hawse style fairlead including an integrated lighting system. Fairlead 1150 may be identical, similar, or share similar features with fairlead 10, as shown in and described with reference to FIG. 1. Fairlead 1150 includes a frame 1120 with a second opening 1109 to receive an integrated light system 1101. Integrated light system 1101 may be similar to or share similar features with integrated light system 601 of FIGS. 6 and 7. It will be appreciated that second opening 1140 may not be visible in FIG. 11, as a bezel 1103 is covering the second opening 1140. In the example embodiment of FIG. 11, integrated light system 1101 in which the light system is segmented into two light segments (which may be included in separate openings, in one example) 1127. It will be appreciated that one or more light segments (e.g., openings for lights of the lighting system) 1127 may be included. In one example, integrated light system may include three light segments contained by bezel 1103. Additionally the second opening 1140 may also be segmented into a corresponding number of openings to accommodate the light segments. In one example, if there are two light segments, then second opening 1140 may be segmented into two separate openings, each one configured to receive one of the light segments. The light segments 1127 may share a common wiring harness 1126, or may be configured with a dedicated wiring harness. Apertures 1142 may serve as fastening location for bolts (not shown) to mount the fairlead to a vehicle bumper, in one example. Integrated light system 1101 may be a front-loaded light system, or a back-loaded light system.

Turning now to FIG. 12, it shows a front perspective view 1200 of an embodiment of the fairlead 1250, where the fairlead 1250 is configured as a hawse fairlead including an integrated lighting system. Fairlead 1250 may be similar to or share features with fairlead 10 of FIG. 1 and/or fairlead 1150 of FIG. 11. In the example shown in FIG. 12, fairlead 1250 may include an upper frame 1220 and a lower frame 1221. It will be appreciated that the upper frame 1220 and the lower frame 1221 may be coupled together using bolts, adhesives, weldment, or other suitable fasteners. Fasteners (not shown) may couple the upper frame 1220 and the lower frame via one or more aperture 1242 in the upper frame 1220. Aperture 1242 may have a corresponding aperture (not shown) in the lower frame 1221 for receiving the fastener. In embodiments that include weldments and/or adhesives, these may be located along all or part of the surfaces of upper frame 1220 and lower frame 1221 that are in face-sharing contact when coupled and/or along a seam 1236 where the upper frame 1220 and the lower frame 1221 contact. Alternatively, the upper frame 1220 and the lower frame 1221 may be formed as one component (e.g., forged), as shown in previous embodiments.

Turning now to FIG. 13, it shows a front perspective view 1300 of an embodiment of the fairlead 1350, where the fairlead 1350 is configured as a hawse fairlead including an integrated lighting system 1301 (e.g., integrated light system). Fairlead 1350 may be similar to or share similar features with fairlead 10 of FIG. 1 and fairlead 1250 of FIG. 12. Fairlead 1350 may include a main frame 1321 with apertures 1332 on either side of a first opening 1322. One or more apertures 1332 may receive a fastener (not shown) to mount the fairlead 1350 to a surface of a vehicle bumper, as will be further described in reference to FIG. 15. A rope and/or cable from a winch (not shown) may extend through first opening 1322 in the fairlead and lateral movement of the rope and/or cable may be constrained to within the first opening 1322. Openings 1317, spaced away from and adjacent to opening 1322 may receive an integrated lighting system 1301. In the depicted example of FIG. 13, openings 1317 may not be visible as lighting system segment 1327 are covering them. As shown, lighting system segments 1327 are located on either side of opening 1322, outside the apertures 1332. It will be appreciated that alternatively, lighting system segments 1327 may be located between apertures 1332 and opening 1322. In some examples, lighting system segments 1327 may be configured to front-load into apertures 1332 after fasteners (not shown) are in place. In this way, a concealed fastener configuration may provide an aesthetically-pleasing front surface 1309.

Turning now to FIG. 14, it shows a front perspective view 1400 of an embodiment of the fairlead 1450, where the fairlead 1450 is configured as a hawse fairlead including an integrated lighting system (not shown). It will be appreciated that the fairlead 1450 is configured to receive a front-loaded integrated light system, such as the integrated light system 601 of FIGS. 6 and 7, but it may also be configured to receive a back-loaded integrated lighting system, such as the integrated lighting system 501 of FIG. 5. It will be appreciated that the integrated lighting system for fairlead 1450 may share similar components (e.g., lights, circuit board, bezel, gasket, lenses) with integrated lighting systems 501 and 601 of FIGS. 5-7. A first frame 1421 may include an opening 1422, opening 1422 being similar to opening 122 of fairlead 10, as shown in FIG. 1. A second frame (also referred to a housing) 1420 may be coupleable to the first frame via a bracket 1460. In the depicted example, bracket 1460 may include a first set of apertures to receive a fastener (not shown) to couple the bracket 1460 to a rear (e.g., rear-facing) surface 1408 of the first frame 1421. Bracket 1460 may also include a second set of apertures 1462 to receive a fastener (not shown) to couple the bracket 1460 to the second frame 1420. As explained further below with reference to FIG. 15, bracket 1460 may be sandwiched (e.g., coupled) between the first frame (e.g., fairlead frame) 1421 and a bumper of a vehicle. In this way, a fastener may pass through apertures 1432 and the first set of apertures of the bracket 1460 to couple the fairlead and the second frame 1420 of the lighting system to the bumper. It will be appreciated that any suitable type of fastener may be to couple the bracket 1460 to the first frame 1421 and the second frame 1420. In the depicted example of FIG. 14, the brackets 1460 are configured to mount the second frame 1420 (which houses the integrated lighting system) above the opening 1422. In other examples, the one or more brackets 1460 may be configured such that they may be inverted to mount the second frame 1420 either above or below the opening 1422. It will be appreciated that the two brackets 1460 shown in the depicted example may be replaced with a single bracket.

Turning now to FIG. 15, it shows a front perspective view 1500 of an embodiment of the fairlead 1450 (as shown in FIG. 14), where the fairlead 1450 is configured as a hawse fairlead including an integrated lighting system. Fairlead 1450 is shown coupled to a bumper 1502, which is coupled to the front of a vehicle 1530. In the depicted embodiment, the rear surface 1408 of fairlead 1450 is mounted in face-sharing contact with a front surface (e.g., front-facing surface) 1504 of bumper 1502. In other examples, a mounting bracket or gasket may be provided between the fairlead 1450 and the front surface 1504 of the bumper 1502. Behind the bumper (e.g., between the bumper 1502 and the vehicle 1530 and behind the front surface 1504) a winch 1506 may be mounted. In this way, the winch 1506 may not be visible as viewed from the front of the bumper. In some examples, winch 1506 may extend above the top surface 1508 of bumper 1502. In other examples, winch 1506 may not extend above the top surface 1508 of bumper 1502. The winch 1506 includes a winch rope 1544 with a hook 1542 attached thereto. The winch rope 1544 extends from the winch 1506 and through the central opening of the fairlead 1450. Any of the fairleads disclosed herein may be included as the fairlead shown in FIG. 15. In this way, any of the central, first openings of the fairleads disclosed here may be adapted to receive the winch rope 1544 extending from a drum of the winch 1506.

Vehicle 1530 may include a vehicle controller 1560. Vehicle controller may be coupled to a controller (e.g., lighting controller) 1540 via a vehicle network, such as a Controller Area Network (CAN) 1580. The controller 1540 may be positioned on or near the bumper 1502. In one embodiment, the controller 1540 may be a winch controller and located within/on the winch 1506. In other examples, controller 1540 may be separate from the winch controller. A user input device (e.g., control device 1570) may be mounted inside the vehicle 1530 such as on the dashboard, handlebars, roll bars, or another vehicle location, and provide control signals to the controller 1540 and receive feedback signals from the controller 1540. In another example, the control device 1570 may be a wireless remote or another type of wireless user interface that is located remote from the winch and lighting system of the fairlead. It will also be noted that the controller 1540 may communicate either wirelessly, via CAN 1580, or through a wired electrical connection with vehicle controller 1560.

As described above, power to the integrated light system may come from a winch 1506 power system, the winch 1506 receiving its power from an external power source such as a vehicle battery or auxiliary battery. The controller may provide control signals to the vehicle controller 1560, which may supply current from the vehicle battery (not shown) to the integrated lighting system and/or to the winch 1506.

The controller may further include a microcontroller unit (MCU) with memory containing programmable data (e.g., instructions) for operating the integrated light system and/or winch components and other auxiliary systems. For example, the controller 1540 may provide control signals to the integrated light system for controlling operating of the integrated light system, and the integrated light system may provide feedback signals to the MCU of the controller 1540. Further, the controller 1540 may provide an electrical connection between the vehicle battery and the integrated light system through the associated control inputs.

As introduced above, the controller 1540 may be in communication with the vehicle Controller Area Network (CAN) bus 1580 for providing communication between the controller 1540 and a vehicle controller 1560. The CAN bus 1580 may exchange information using a scheduled periodic rate. Specifically, the controller 1540 may include a CAN module, electrically coupled to the MCU, for providing electronic communication between the controller 1540 and the CAN bus 1580. The CAN module may convert signals received from the MCU, into a CAN data stream, which may then be transmitted to the vehicle controller 1560 via the CAN bus. Likewise, the CAN module may convert and relay the CAN data stream received from the vehicle controller 1560 into an electrical signal interpretable by the MCU. CAN bus may therefore provide electronic communication between the vehicle controller 1560, and the CAN module.

By connecting the controller to the CAN bus, operation of the integrated light system 1101 and/or winch 1506 may be adjusted based on a model of a vehicle to which the integrated light system and winch 1506 is coupled and/or based on vehicle operating parameters. For example, the integrated light system 1101 may be powered on responsive to an indication from the controller 1540 that the winch 1506 is in operation. In another example, backlighting (e.g., "running lights") may be illuminated responsive to an indication from vehicle controller 1560 that the vehicle engine is operating. In further examples, an operator may send an indication of a desire to change the illumination levels, illumination color, or the aim of the integrated lighting system 1101. The controller 1540 will send a signal to the integrated light system to adjust operation of the integrated light system to meet these demands. Further, operation of the integrated light system 1101 may be adjusted based on vehicle and winch operating parameters such as any one or more of winch speed, vehicle speed, vehicle incline, steering angle, engine temperature, brake pressure, engine load, charge state of the battery, and current and/or voltage output from the battery, etc. Additionally, operating of the integrated lighting system 1101 may be adjusted based on environmental conditions such as an indication of ambient light. In one example, the integrated light system 1101, including backlighting, may be illuminated responsive to an indication of a level of ambient light from a photo diode or light sensor (not shown). Therein, responsive to a vehicle controller 1560 receiving an indication of ambient light below a threshold, the vehicle controller 1560 may send a signal to the controller 1540 to actuate the integrated light system in order to illuminate one or more lights of the integrated light system. In other examples, automatic control of the integrated light system 1101 may be responsive to indications of a vehicle engine running condition, ambient light thresholds, winch operation condition, or an off-road condition indication.

Optionally or additionally, fairlead 1150 may include a switch 1538 coupled to the frame of the fairlead. Switch 1538 may be any suitable switch (e.g., toggle, button) that may be used to control the operation of the integrated light system. The switch may be used to send a signal to deliver power to the integrated light system and illuminate lights coupled to the integrated light system. It will be appreciated that the switch 1538 may also be coupled to the bumper, winch, a vehicle dashboard or other suitable location. Thus, a vehicle operator may adjust the operating of the integrated light system 1101 by manipulating a dashboard switch on a dashboard of the vehicle. In one embodiment, the communication between the controller 1540 and the control device 1570 may be performed by a wired connection from the control device 1570 to the integrated light system, and in another embodiment this connection could be wireless.

The control device 1570 may also include a microcontroller unit (MCU) for generating control signals to be sent to the integrated light system 1101 and/or winch 1506. The MCU may contain programmable data (e.g., stored on a memory of the MCU) for processing inputs received from one or more of a display (not shown) and input buttons (not shown) of the user input control device 1570. The MCU may then send signals corresponding to the received inputs to the MCU of the controller 1540, which may in turn accordingly adjust operation of the integrated light system and/or winch and/or accessories. Additionally, the control device 1570 may include a power management module (not shown) which may be electrically coupled to the vehicle battery (not shown). However, in another example, the control device 1570 may include its own dedicated battery (now shown), which may be coupled to the power management module for providing electrical power to the control device 1570. Thus, in some examples, the power management module may be not be coupled to the vehicle battery and may draw electrical power from the dedicated battery. In such examples, the control device may be wirelessly connected to the controller 1540

Turning now to FIG. 16, it shows a side perspective view 1600 of an embodiment of fairlead 10, where the fairlead 10 is configured as a hawse fairlead and includes an integrated lighting system 501. Fairlead 10 is shown in FIG. 1-5. In the depicted example, fairlead 10 is shown coupled to a front surface 1604 of a bumper 1602. Bumper 1602 may be similar to or share similar features with bumper 1502 of FIG. 15. In alternate embodiments, fairlead 10 may additionally or alternatively couple to a front surface of a winch. This may occur when the winch protrudes forward of the front surface 1604 of the bumper 1602 or when the winch is mounted to the front surface of the bumper rather than behind the bumper, as shown in FIG. 15. According to a further aspect of the present disclosure, a switch 1623 may be coupled to the fairlead 1650 and may be actuated by an operator to provide power to the integrated light system 1601, thereby illuminating the lights or to stop proving power to the integrated light system 1601, thereby turning the lights off. In the depicted example, switch 1623 is coupled to the side surface 1610 of the second frame 1621, but it will be appreciated that the switch 1623 may be mounted to any suitable surface of the second frame 1621 or to any suitable surface of first frame 1620. According to another aspect of the present disclosure, lighting system 1601 may be connected to a controller 1640 for controlling the lighting system and for connecting a power source to the wiring harness of the integrated light system 1601. Controller 1640 may be coupled to a vehicle controller 1660 (via CAN 1680) and a control device 1670. These control devices may be similar to those described in reference to FIG. 15. In one non-limiting example, the controller 1640 may be used to adjust the operational status of the lighting system of fairlead 10, including at least one of a power on/power off, light color emitted by lights of the lighting system, a light color emitted by backlights of the lighting system (or a separate backlighting system), a light beam aiming angle of the lights of the lighting system, and low/high beam condition of lights of the lighting system. For example, the controller 1640 may receive one or more control signals from one or more control devices 1670 and then send corresponding control signals to the lighting system via the wiring harness 208. According to a further aspect of the present disclosure, the control device is provided so that the lighting system, winch (e.g., winch 1506 of FIG. 15), or other auxiliary devices may communicate with the control device 1670 on a unique identification code that is established by the device through an operator "pairing" process.

In one example, the control device 1670 may be a wireless remote control device for controlling the lighting system which may include a first button that is dedicated to control the power to the light system (e.g., an on/off switch). The wireless remote may include a second button dedicated to control a lighting level of the lighting system (e.g., a high beam or low beam condition). A high beam condition may be suitable for use in low-light or night time conditions. A low beam condition may be suitable for use in a daytime condition or for aesthetic effect. The control device may include a third button configured for adjusting the aim of the lighting system. In one example, an operator may wish to aim the lights downward to illuminate the area immediately to the front of a vehicle (not shown). In other examples, the operator may wish to direct illumination from the lighting system to an elevated focal point, toward a horizon or skyward, for example. It will be appreciated that for embodiments that include more than one lighting segment, individual lighting segments may be controlled collectively or individually. In one example, a lighting segment located above opening 122 may be aimed in a first direction, while a lighting segment located below opening 122 may be aimed in a second direction, the first direction different than the second direction. In alternate embodiments, control device may include a single toggle button for controlling operating conditions of the integrated light system 1601, or control device 1670 may include a touchscreen display via which an operator may select different options, functions, and operating modes of the lighting system 1601.

According to a further aspect of the present disclosure, the wireless remote can be downloaded with software or data through a data connection to a programming module or computer. The wireless remote can have its software and data modified through a connection to the computer or a programming module. The control device may be powered by a rechargeable battery connected through a plug on a body of the control device.

According to a further aspect of the present disclosure, the controller 1540 may be configured to distribute vehicle battery power to the control device and lighting system and may be capable of updating the winch controller through wireless communication, and communicate through a secured and encrypted wireless communication protocol.

Turning now to FIG. 17, it shows a top view 1700 of an embodiment of lights 1705 that may be contained in an integrated light system, such as the integrated light system 501 of FIG. 5, integrated light system 601 of FIG. 7, integrated light system 1101 of FIG. 11, and integrated light system 1301 of FIG. 13. In the depicted example, five lights are shown (e.g., 1706, 1708, 1710, 1712, and 1714), although it will be appreciated that more or fewer lights may be used. Additionally, lights 1705 may not be in a straight line as depicted, rather, they may be located at different locations and integrated into a fairlead (e.g., fairlead 10 of FIG. 1 in one non-limiting example) in a plurality of configurations. FIG. 17 demonstrates that the lights 1705 may be adjusted in such a way that the focal point of lights 1705 may be adjusted individually. In the depicted example, light 1706 is adjusted in a direction 1709 that is at an angle 1720 with respect to a direction 1707 which is parallel with axis 156 (which may be perpendicular to a frame of the fairlead in which the lights are integrated into). Likewise, light 1714 is adjusted in a direction 1711 that is at an angle 1721 with respect to the direction 1707 which his parallel with axis 156. In some examples, all lights may be controlled individually (via a controller, such as controller 1540 and 1640 shown in FIGS. 15 and 16, respectively), while in other examples, subsets of lights may be controlled. Lights may be able to pivot or tilt such that the focal point of each light may be adjusted in both a vertical direction and a horizontal direction. The brightness and or light dispersion levels may also be controlled. In one example, lights 1706 and 1714 may be adjusted to deliver "flood" lighting, where the light is highly dispersed, illuminating a wide area. Alternately, lights 1708, 1710, and 1712 may be adjusted to deliver "spot" lighting" where the light focus is increased, offering increased illumination over a more focused region.

Thus, a fairlead may include an integrated lighting system. The integrated lighting system may be included within the fairlead frame, and may project light from the fairlead frame in more than one direction. Specifically, the integrated lighting system may project light in opposite directions, out the front and back of the fairlead. In this way, a technical effect of increasing ease of attachment, inspection, and operation of the fairlead is achieved by providing lighting to the rear of the fairlead. Further by integrating the lighting system within the frame, the complexity of the fairlead system may be reduced, and the structural integrity of the system may be increased relative to systems where the lights are coupled to an external surface of the fairlead or external to the fairlead frame.

Further, the lighting system may comprise LED lights, where LED semiconductor or crystal light sources may be included on a circuit board, and may generate visible light in response to a generated electric field. The circuit board may be in face-sharing contact with the fairlead frame. By positioned the circuit board in face-sharing contact with the fairlead frame, a technical effect of increasing heat dissipation from the circuit board is achieved. In this way, heat degradation to the lights and circuit board may be reduced, and the maximum operating duration of the lights may be increased.

As one embodiment, a fairlead comprises: a frame including a central, first opening and a second opening spaced away from the first opening; and a lighting system included within the frame, the lighting system comprising a plurality of lights disposed within and extending along the second opening. In one example, the second opening is positioned adjacent to the first opening. In another example, the second opening is positioned vertically above the first opening. In yet another example, the second opening is positioned to a side of the first opening.

In a first example, the lighting system is integrated with the frame and the first opening extends through an entirety of the frame from a front-facing surface to a rear-facing surface of the frame, where the front-facing surface and rear-facing surface are in parallel with one another, and wherein the first opening is defined by a first perimeter at the front-facing surface and a second perimeter at the rear-facing surface, where the first perimeter is larger than the second perimeter and wherein the first opening has a continuous curved surface that curves outward from the second perimeter to the first perimeter. For example, the second opening extends through the entirety of the frame from the front-facing surface to the rear-facing surface of the frame and the second opening has a second length that is shorter than a first length of the second perimeter of the first opening. The fairlead may further comprise a circuit board mount including an outer flange directly coupled to the rear-facing surface of the frame and a body extending outward from the outer flange and into the second opening of the frame, toward the front-facing surface of the frame, wherein an inner surface of the body forms a mount central opening. In one example, the circuit board is disposed within the mount central opening and outer edges of the circuit board are in face sharing contact with the inner surface of the body of the circuit board mount. The fairlead may further comprise a wire harness directly and electrically coupled to the circuit board and extending outward from the circuit board in a direction away from the rear-facing surface of the frame. Further, the plurality of lights may be LED lights, where the lights comprise the circuit board and a plurality of reflectors, the circuit board including a first set of LED semiconductor light sources on a front first surface, and where the plurality of reflectors are mounted within the mount central opening in front of the circuit board with respect to the front-facing surface of the frame. The fairlead may further comprise a lens positioned in front of the plurality of lights relative to the front-facing surface of the frame and further comprising a first gasket positioned between and in face sharing contact with each of a rear facing inner surface of the second opening of the frame and a forward facing outer surface of the lens. In one example, the first gasket is positioned between and in face sharing contact with each of the rear facing inner surface of the second opening of the frame and a forward facing outer surface of the body of the circuit board mount, where the forward facing outer surface of the body is spaced away from the outer flange of the circuit board mount. The fairlead may further comprise a second gasket positioned around a perimeter of an outer surface of the body of the circuit board mount, where the second gasket is further positioned between and in face sharing contact with each of a forward facing surface of the outer flange and the rear-facing surface of the frame, around the second opening. The fairlead may further comprise a plurality of rear-facing lenses, and where the circuit board further includes a second set of LED semiconductor light sources on a rear second surface, the rear second surface of the circuit board opposite the front first surface of the circuit board, and where light generated by the second set of LED semiconductors passes through the rear-facing lenses and out of the rear-facing surface of the frame.

In a second example, the lighting system is integrated with the frame, where the first opening extends through an entirety of the frame from a front-facing surface to a rear-facing surface of the frame, where the front-facing surface and rear-facing surface are in parallel with one another, where the second opening extends into the frame from the front-facing surface, and where the rear-facing surface of the frame covers the second opening at the rear-facing surface of the frame, defining a back of the second opening. In one example, a circuit board is disposed within the second opening and outer edges of the circuit board are in face sharing contact with inner walls of the frame which form the second opening, wherein the plurality of lights comprise the circuit board and a plurality of reflectors, the circuit board including a first set of LED semiconductor light sources on a front first surface and a second set of LED semiconductor light sources on a rear second surface, the rear second surface of the circuit board opposite the front first surface of the circuit board. In another example, the rear second surface of the circuit board is in face-sharing contact with the frame at an interior surface of the back of the second opening. In yet another example, the second opening includes a central opening portion, a lip portion, and a forward slot portion, where the central opening portion extends from a back of the second opening up to the lip portion, and where the lip portion extends from the central opening portion up to the forward slot portion, and where the forward slot portion extends from the lip portion up to a front-facing surface of the frame, and where a cross-sectional area of the forward slot portion is greater than that of the lip portion, and where a cross-sectional area of the lip portion is greater than that of the central opening portion, and where the transition between the portions comprises a step. The fairlead may further comprise a bezel coupled to the second opening and forming a portion of the front-facing surface of the frame and further comprising a gasket positioned directly between a lens and the bezel.

As another embodiment, a fairlead comprises a frame including a first opening and a second opening, the first and second openings extending through an entirety of the frame from a front-facing surface of the frame to a rear-facing surface of the frame, where the second opening is positioned vertically above the first opening; and a lighting system included within the second opening, the lighting system comprising a plurality of lights and a mount, the mount coupled to the rear-facing surface of the frame. In one example, the mount includes an outer flange directly coupled to the rear-facing surface of the frame and a body extending outward from the outer flange and into the second opening of the frame, toward the front-facing surface of the frame, where an inner surface of the body forms a mount central opening and further comprising a circuit board disposed within the mount central opening, where outer edges of the circuit board are in face sharing contact with the inner surface of the body of the mount.

As yet another embodiment, a fairlead comprises: a frame including a first opening extending through an entirety of the frame from a front-facing surface of the frame to a rear-facing surface of the frame, and a second opening disposed above the first opening, the second opening extending only partially through the frame from the front-facing surface; and a lighting system included within the second opening, the lighting system comprising a plurality of lights and a bezel, the bezel coupled to the front-facing surface of the frame. In one example, the second opening includes a central opening portion, a lip portion, and a forward slot portion, where the central opening portion extends from a back of the second opening up to the lip portion, where the lip portion extends from the central opening portion up to the forward slot portion, and where the forward slot portion extends from the lip portion up to the front-facing surface of the frame, and wherein the bezel is directly mounted to front-facing walls of the lip portion which are arranged in parallel with the front-facing surface of the frame.

In another representation, a system for a vehicle comprises: a vehicle bumper including a front-facing outer (e.g., front) surface, the vehicle bumper positioned at a front-end (e.g., front) of the vehicle; a winch positioned within the bumper, behind and covered by the front-facing outer surface, the winch including a fairlead mounted to (or coupled to the bumper in front of) a front of the winch and positioned forward of the front-facing outer surface; and a lighting system coupled with the fairlead, where the lighting system and the fairlead are visible from front-end of the vehicle. In one example, the lighting system is integrated with and included within a frame of the fairlead. In another example, the lighting system is mounted directly to a forward-facing surface of a frame of the fairlead. In yet another example, the lighting system is coupled (e.g., sandwiched) between the vehicle bumper and the fairlead via a mounting bracket. For example, the mounting bracket may be positioned between a rear-facing surface of the fairlead and vehicle bumper and the lighting system may be positioned vertically above a central opening of the fairlead that is adapted to receive a rope. For example, the lighting system may be positioned vertically above a top surface of the frame, the top surface arranged perpendicular to the forward-facing surface, via the mounting bracket.

In yet another representation, a fairlead assembly comprises: a fairlead including a frame, the frame including a central, first opening adapted to receive a rope; and a lighting system coupled with the frame and including a light source. In one example, the lighting system is directly mounted to the frame. In another example, the lighting system is included within a housing (e.g., upper frame) and the housing is directly mounted to a top of the frame, above the first opening. In yet another example, the lighting system is included within a housing and the housing is coupled to a mounting bracket and the mounting bracket is directly coupled to a rear-facing surface of the frame of the fairlead. For example, the mounting bracket may extend above a top surface of the frame and the lighting system may be positioned above the top surface of the frame and the first opening. In another example, the light source includes a plurality of lights. In yet another example, the frame includes at least one second opening and the lighting system is integrated within the at least one second opening of the frame. In still another example, the frame includes a plurality of second openings (or a second opening segmented into a plurality of openings and corresponding light segments) and the lighting system is integrated within the plurality of second openings. As one example, power (e.g., a power cable or wiring harness) to the light source of the lighting system is routed through the frame of the fairlead. In another example, power to the light source of the lighting system is coupled to the frame. The fairlead assembly may further comprise a second, backlight lighting system. In one example, the light source of the lighting system is a forward-facing light source and the backlight lighting system includes at least one backlight. As one example, the at least one backlight is an LED light source. As another example, the at least one backlight is a colored light. As yet another example, the at least one backlight is a colored light and the forward-facing light source of the lighting system is a white light. In another example, an angle of the light source of the lighting system, relative to the frame, is adjustable. In yet another example, the light source includes a plurality of lights and angled of each light of the plurality of lights is adjustable relative to the frame and other lights of the plurality of lights.

In still another representation, a fairlead comprises: a fairlead including a frame, the frame including a central, first opening adapted to receive a rope and a plurality of second openings, each of the plurality of second openings arranged adjacent to the first opening; and a lighting system included within the frame, the lighting system comprising a plurality of lights disposed within the plurality of second openings.

In another representation, a system comprises: a fairlead of a winch, the fairlead including a frame and a lighting system integrated within the frame, where the frame includes a central, first opening adapted to receive a rope and a second opening arranged separate from the first opening, where the lighting system is disposed within the second opening; and a controller electronically coupled with the lighting source and in electronic communication with a control device, where the controller includes memory with instructions for controlling the lighting source based on control signals received from the control device. In one example, the control device is one or more of a remote control device and a vehicle controller of a vehicle to which the winch is attached, where the vehicle controller is in communication with the controller via a vehicle control network of the vehicle. In another example, the controller is coupled to a power source of the winch. In yet another example, the controller is a controller of the winch (e.g., winch controller) and the controller is coupled to a vehicle power source.

In yet other representations, the integrated lighting system may be both front-loaded and back-loaded, where some of the components of the lighting system may be loaded from the front of the fairlead frame, while other components may be loaded from the back of the fairlead frame.

It will be appreciated that the configurations disclosed herein are exemplary in nature, and that these specific embodiments are not to be considered in a limiting sense, because numerous variations are possible. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A fairlead, comprising:

a fairlead frame including a first opening and a second opening spaced away from the first opening; and a lighting system included within the fairlead frame, the lighting system comprising a plurality of lights disposed within and extending along the second opening, wherein the lighting system is integrated with the fairlead frame and wherein the first opening extends through an entirety of the fairlead frame from a front-facing surface to a rear-facing surface of the fairlead frame, where the front-facing surface and rear-facing surface are in parallel with one another, and wherein the first opening is defined by a first perimeter at the front-facing surface and a second perimeter at the rear-facing surface, where the first perimeter is larger than the second perimeter and wherein the first opening has a continuous curved surface that curves outward from the second perimeter to the first perimeter.

2. The fairlead of claim 1, wherein the second opening extends through the entirety of the fairlead frame from the front-facing surface to the rear-facing surface of the fairlead frame and wherein the second opening has a second length that is shorter than a first length of the second perimeter of the first opening.

3. The fairlead of claim 2, further comprising a circuit board mount including an outer flange directly coupled to the rear-facing surface of the fairlead frame and a body extending outward from the outer flange and into the second opening of the fairlead frame, toward the front-facing surface of the fairlead frame, wherein an inner surface of the body forms a mount central opening.

4. The fairlead of claim 3, wherein a circuit board is disposed within the mount central opening and outer edges of the circuit board are in face sharing contact with the inner surface of the body of the circuit board mount.

5. The fairlead claim 4, further comprising a wire harness directly and electrically coupled to the circuit board and extending outward from the circuit board in a direction away from the rear-facing surface of the fairlead frame.

6. The fairlead of claim 4, wherein the plurality of lights are LED lights, where the lights comprise the circuit board and a plurality of reflectors, the circuit board including a first set of LED semiconductor light sources on a front first surface, and where the plurality of reflectors are mounted within the mount central opening in front of the circuit board with respect to the front-facing surface of the fairlead frame.

7. The fairlead of claim 6, further comprising a lens positioned in front of the plurality of lights relative to the front-facing surface of the fairlead frame and further comprising a first gasket positioned between and in face sharing contact with each of a rear facing inner surface of the second opening of the fairlead frame and a forward facing outer surface of the lens.

8. The fairlead of claim 7, wherein the first gasket is positioned between and in face sharing contact with each of the rear facing inner surface of the second opening of the fairlead frame and a forward facing outer surface of the body of the circuit board mount, wherein the forward facing outer surface of the body is spaced away from the outer flange of the circuit board mount.

9. The fairlead of claim 7, further comprising a second gasket positioned around a perimeter of an outer surface of the body of the circuit board mount, wherein the second gasket is further positioned between and in face sharing contact with each of a forward facing surface of the outer flange and the rear-facing surface of the fairlead frame, around the second opening.

10. The fairlead of any of claim 6, further comprising a plurality of rear-facing lenses, and where the circuit board further includes a second set of LED semiconductor light sources on a rear second surface, the rear second surface of the circuit board opposite the front first surface of the circuit board, and where light generated by the second set of LED semiconductors passes through the rear-facing lenses and out of the rear-facing surface of the fairlead frame.

11. The fairlead of claim 1, wherein the lighting system is integrated with the fairlead frame, wherein the first opening extends through an entirety of the fairlead frame from a front-facing surface to a rear-facing surface of the fairlead frame, where the front-facing surface and rear-facing surface are in parallel with one another, wherein the second opening extends into the fairlead frame from the front-facing surface, and wherein the rear-facing surface of the fairlead frame covers the second opening at the rear-facing surface of the fairlead frame, defining a back of the second opening.

12. The fairlead of claim 11, wherein a circuit board is disposed within the second opening and outer edges of the circuit board are in face sharing contact with inner walls of the fairlead frame which form the second opening, wherein the plurality of lights comprise the circuit board and a plurality of reflectors, the circuit board including a first set of LED semiconductor light sources on a front first surface and a second set of LED semiconductor light sources on a rear second surface, the rear second surface of the circuit board opposite the front first surface of the circuit board.

13. The fairlead of any claim 12, wherein the rear second surface of the circuit board is in face-sharing contact with the fairlead frame at an interior surface of the back of the second opening.

14. The fairlead of claim 11, wherein the second opening includes a central opening portion, a lip portion, and a forward slot portion, where the central opening portion extends from a back of the second opening up to the lip portion, and where the lip portion extends from the central opening portion up to the forward slot portion, and where the forward slot portion extends from the lip portion up to a front-facing surface of the fairlead frame, and where a cross-sectional area of the forward slot portion is greater than that of the lip portion, and where a cross-sectional area of the lip portion is greater than that of the central opening portion, and where the transition between the portions comprises a step.

15. The fairlead of claim 14, further comprising a bezel coupled to the second opening and forming a portion of the front-facing surface of the fairlead frame and further comprising a gasket positioned directly between a lens and the bezel.

16. A fairlead, comprising:

a fairlead frame including a first opening and a second opening, the first and second openings extending through an entirety of the fairlead frame from a front-facing surface of the fairlead frame to a rear-facing surface of the fairlead frame, where the second opening is positioned vertically above the first opening; and a lighting system included within the second opening, the lighting system comprising a plurality of lights and a mount, the mount coupled to the rear-facing surface of the fairlead frame wherein the lighting system is integrated with the fairlead frame and wherein the first opening extends through an entirety of the fairlead frame from a front-facing surface to a rear-facing surface of the fairlead frame, where the front-facing surface and rear-facing surface are in parallel with one another, and wherein the first opening is defined by a first perimeter at the front-facing surface and a second perimeter at the rear-facing surface, where the first perimeter is larger than the second perimeter and wherein the first opening has a continuous curved surface that curves outward from the second perimeter to the first perimeter.

17. The fairlead of claim 16, wherein the mount includes an outer flange directly coupled to the rear-facing surface of the fairlead frame and a body extending outward from the outer flange and into the second opening of the fairlead frame, toward the front-facing surface of the fairlead frame, where an inner surface of the body forms a mount central opening and further comprising a circuit board disposed within the mount central opening, where outer edges of the circuit board are in face sharing contact with the inner surface of the body of the mount.

18. A fairlead, comprising:

a fairlead frame including a first opening extending through an entirety of the fairlead frame from a front-facing surface of the fairlead frame to a rear-facing surface of the fairlead frame, and a second opening disposed above the first opening, the second opening extending only partially through the fairlead frame from the front-facing surface; and a lighting system included within the second opening, the lighting system comprising a plurality of lights and a bezel, the bezel coupled to the front-facing surface of the fairlead frame, wherein the lighting system is integrated with the fairlead frame and wherein the first opening extends through an entirety of the fairlead frame from a front-facing surface to a rear-facing surface of the fairlead frame, where the front-facing surface and rear-facing surface are in parallel with one another, and wherein the first opening is defined by a first perimeter at the front-facing surface and a second perimeter at the rear-facing surface, where the first perimeter is larger than the second perimeter and wherein the first opening has a continuous curved surface that curves outward from the second perimeter to the first perimeter.

19. The fairlead of claim 18, wherein the second opening includes a central opening portion, a lip portion, and a forward slot portion, where the central opening portion extends from a back of the second opening up to the lip portion, where the lip portion extends from the central opening portion up to the forward slot portion, and where the forward slot portion extends from the lip portion up to the front-facing surface of the fairlead frame, and wherein the bezel is directly mounted to front-facing walls of the lip portion which are arranged in parallel with the front-facing surface of the fairlead frame.

* * * * *